United States Patent [19]

Wybauw

[11] 4,364,206

[45] Dec. 21, 1982

[54] PREFABRICATED BUILDING UNITS FOR CONSTRUCTING BUILDING, AND BUILDINGS WHOSE FABRIC COMPRISES ASSEMBLED UNITS OF THIS KIND

[76] Inventor: Jacques Wybauw, 41 Avenue Brunard, 1180 - Bruxelles, Belgium

[21] Appl. No.: 100,374

[22] Filed: Dec. 5, 1979

[30] Foreign Application Priority Data

| | | | |
|---|---|---|---|
| Dec. 11, 1978 | [FR] | France | 78 34744 |
| May 2, 1979 | [FR] | France | 79 11027 |
| Jun. 12, 1979 | [FR] | France | 79 14983 |

[51] Int. Cl.[3] ..... E04B 1/348

[52] U.S. Cl. ..... 52/79.7; 52/79.1; 52/79.9; 52/185

[58] Field of Search ..... 52/79.1, 79.7, 79.9, 52/185

[56] References Cited

U.S. PATENT DOCUMENTS

| | | | |
|---|---|---|---|
| 1,362,069 | 12/1920 | Witzel | 52/745 |
| 1,995,573 | 3/1935 | Matthews | 52/262 X |
| 3,256,652 | 6/1966 | van der Lely | 52/79.9 |
| 3,293,814 | 12/1966 | Zugehor | 52/79.1 X |
| 3,430,398 | 3/1969 | Green | 52/79.2 |
| 3,461,633 | 8/1969 | Ziegelman et al. | 52/79.9 X |
| 3,484,999 | 12/1969 | van der Lely | 52/79.7 |
| 3,550,334 | 12/1970 | van der Lely | 52/185 X |
| 3,727,753 | 4/1973 | Starr et al. | 52/79.7 |
| 3,818,654 | 6/1974 | Schramm | 52/79.7 |
| 3,971,172 | 7/1976 | Gentil | 52/28 |
| 4,065,905 | 1/1978 | van der Lely | 52/79.1 |

FOREIGN PATENT DOCUMENTS

| | | | |
|---|---|---|---|
| 290175 | 12/1965 | Australia | 52/79.1 |
| 50451 | 11/1970 | Australia . | |
| 778542 | 2/1968 | Canada | 52/79.1 |
| 1965417 | 7/1970 | Fed. Rep. of Germany . | |
| 2018402 | 3/1972 | Fed. Rep. of Germany . | |
| 2420845 | 12/1974 | Fed. Rep. of Germany | 52/79.7 |
| 2386482 | 2/1975 | Fed. Rep. of Germany | 52/79.1 |
| 2601850 | 7/1977 | Fed. Rep. of Germany | 52/79.1 |
| 1953657 | 12/1978 | Fed. Rep. of Germany | 52/79.1 |
| 1260059 | 3/1961 | France . | |
| 1334474 | 7/1963 | France . | |
| 2320398 | 3/1977 | France . | |
| 1010812 | 11/1965 | United Kingdom . | |
| 1257500 | 12/1971 | United Kingdom . | |
| 1476959 | 6/1977 | United Kingdom . | |

*Primary Examiner*—Alfred C. Perham
*Attorney, Agent, or Firm*—W. R. Hulbert

[57] ABSTRACT

The invention provides prefabricated building units for constructing buildings.

Each unit consists of a structure having the shape of a right prism comprising a lower frame, an upper frame and uprights having a V-shaped section. In general a building unit also comprises an upper wall and a lower wall connected to the top portion of the upper frame and lower frame respectively. Each of these walls forms with the frame which supports it an empty box open at the bottom. The joining by bolting together superposed and/or juxtaposed building units constitutes the fabric of a building.

18 Claims, 51 Drawing Figures

A
A

PREFABRICATED BUILDING UNITS FOR CONSTRUCTING BUILDING, AND BUILDINGS WHOSE FABRIC COMPRISES ASSEMBLED UNITS OF THIS KIND

The present invention relates to the construction of buildings whose fabric is formed by the superposition and juxtaposition of prefabricated building units.

It is known to construct buildings by means of elements prefabricated in the factory. Numerous building systems of this kind have already been proposed and used.

In particular, various building systems are known which are based on "heavy prefabrication" and in which the prefabricated elements consist principally of panels, beams, or three-dimensional cells of reinforced concrete. Transport and handling costs account for an appreciable proportion of the total cost of buildings produced in this manner. Consequently, heavy prefabrication is applicable and economic only when the distance from the prefabricating factory to the building site is not too great. Beyond a certain distance or when means of communication are poor, transport costs rapidly outweigh the advantage gained by the prefabrication of the elements.

Various building systems based on "light prefabrication" are also known. These systems, which mainly make use of metallic prefabricated elements, are often applied only to a part of the building, as is the case in particular where "curtain walls" or "façade panels" are concerned.

Certain known techniques nevertheless make it possible to construct buildings composed entirely or almost entirely of light prefabricated elements. In general, these known techniques are nevertheless limited to the construction of specific buildings, particularly those of low height and mainly single-storey buildings.

One aim of the present invention is to produce rapidly and economically multistorey buildings with the aid of a light prefabrication technique which, while using standardised prefabricated building elements, nevertheless permits great flexibility in the architectural design of the buildings which can be produced with its aid, so that these buildings are suitable for various uses.

Another aim of the invention is to produce buildings by the assembly on the site of only slightly diversified light prefabricated elements which are easy to produce in series, easy to store and transport, and which can be easily assembled and dismantled by not very highly skilled labour.

Another aim of the invention is to produce buildings in which the construction of parts above ground level can dispense with any masonry work, since the prefabricated elements used can be simply bolted together.

Another aim of the invention is to produce multistorey buildings which, once constructed, can easily be extended or converted to a new use or adapted to new needs or requirements of the occupants, and which can even be entirely dismantled and re-assembled elsewhere.

Another aim of the invention is to produce buildings which, because of their extreme flexibility of architectural expression and of a simple and effective system of temperature control, are suitable for erection in any region and in any climate, and which in addition can be perfectly integrated in any existing urban site because of their perfect adaptability to the lay-out of roads, streets, and squares already in existence, this being due to the diversity of their shape and the number of their storeys.

Another aim of the invention is to make it very easy to incorporate under the buildings, in a technical cavity resulting from the system itself, all the horizontal urban infrastructure pipes and cables which are usually buried in the ground of the road systems serving the buildings.

The present invention has as its object a system for the building of the fabric of buildings through the on-site assembly of only slightly diversified prefabricated building units.

Each building unit according to the present invention consists of a structure having roughly the shape of a right prism, and comprises:

a bottom frame formed of elements selected from wide flat metal elements, metal sections, and wooden beams, these elements being disposed along the lateral faces of the said prism in such a manner that the bottom edge of this bottom frame forms the lower base sides of the said prism;

an upper frame composed of elements selected from wide flat metal elements, metal sections, and wooden beams, these elements being disposed along the side faces of the said prism in such a manner that the top edge of this upper frame forms the sides of the upper base of the said prism;

uprights having a V-shaped section and made of a material selected from metals and woods, these uprights joining together the previously mentioned bottom and top frames, and each upright being disposed in such a manner that its edge forms a vertical edge of the said prism and that its flanges are disposed along the side faces of the said prism.

Most of the building units used also have a top horizontal wall and/or a bottom horizontal wall.

A top horizontal wall consists of a plate joined to the top edge of the said upper frame, thus forming the upper base of the said prism, the said plate being self-supporting and made of a building material selected from metal sheets, thick plywoods, and boards of reinforced plastics material, so that the upper frame and the top wall together form an empty box which is open in the downward direction.

A bottom horizontal wall consists of a plate joined to the top part of the said lower frame, this plate being self-supporting and made of a material selected from metal sheets, thick plywoods, and boards of reinforced plastics material, so that the bottom frame and the bottom wall together form an empty box open in the downward direction.

The invention will be described hereinbelow mainly with reference to building units made entirely of metal (and more particularly of steel).

It must however be understood that the building units according to the invention may also be entirely or partially made of wood.

In particular, wood and steel may be used at the same time. In this case, certain component elements of the building elements (for example the top and bottom frames and optionally the upper and lower walls) are made of wood, while the other component elements are made of steel. Reinforced plastics materials may also be used in part in the construction of the building units, in particular for forming the upper horizontal walls.

The general shape of the building units is the same whatever the materials used to produce them. The assembly means for joining together the component elements of the building units must obviously be selected in accordance with the materials to be joined together.

When the building unit has a bottom horizontal wall, it is advantageous for the latter to be provided over its entire periphery with a small upwardly directed edging projecting to a slight height (for example of the order of 10 mm) above the upper face of the bottom wall.

In one advantageous embodiment the bottom horizontal wall and/or the top horizontal wall (of building units in which these walls are provided) have apertures near the vertical edges of the building unit.

The bottom horizontal wall and/or the top horizontal wall of a building unit may have one or more apertures of a size permitting the passage of a man, and these apertures may be closed by removable attached panels.

As will be seen from the continuation of the description, other building units are specially designed to permit passage (by means of a lift or staircase) between superposed building units.

The rigidity of the top and bottom walls is preferably reinforced by means of stiffeners consisting of ribs fixed by means known per se against one face of the walls. The stiffeners of a bottom wall are fixed against the lower face of the latter; the stiffeners of an upper wall may be fixed against the lower face or upper face of the latter.

The upper and lower frames and the uprights of the building units may also be reinforced by means of similar stiffeners. In this case, these stiffeners are fixed against the inwardly directed faces of the building unit, so that no part of the building unit projects beyond the faces of the prism formed by this building unit.

In one advantageous embodiment the building unit is in the form of a right prism having a standard height common to all the building units used for the construction of one and the same building; furthermore, in one particular embodiment at least two sides of the base of the said prism have a length which is equal to a reference length common to all the building units used, or to a multiple of this reference length.

The building units may be made entirely in the factory and transported in that form to the building sites.

In a preferred embodiment the building unit is however formed by assembling by means known per se (for example by bolting or welding) factory-prefabricated elements comprising:

1. A bottom part selected from the previously mentioned lower frames and these lower frames provided with a bottom wall;

2. A top part selected from the previously mentioned upper frames and these upper frames provided with a top wall;

3. The uprights of the building unit.

In one particular embodiment a building unit is in the form of a right prism having a rectangular base and is produced by on-site assembly, by means known per se, of factory-prefabricated elements comprising:

1. A bottom part which in turn is made by joining together side by side, on the site, two identical rectangular parts, each of which comprises a lower frame and a bottom wall;

2. A top part which is turn is made by joining together side by side, on the site, two identical rectangular parts, each of which comprises an upper frame and a top wall;

3. Four uprights.

In order to simplify the explanation, the building units according to the invention will be called "units" in the remainder of the present description.

The invention also has as its object a building whose fabric is at least partly formed by bolting together superposed and/or juxtaposed units.

In one particular embodiment the building comprises one or more units which are not supported by their bottom face and which are fixed solely by one or more of their side faces against one or more side faces of juxtaposed units.

In one advantageous embodiment the building according to the invention comprises a stack or a plurality of stacks spaced apart from one another, each stack being formed of units resting one on the other, each storey of each stack being composed of a unit or of two or more juxtaposed units joined together, spacer parts providing a space between the top edge of the upper frame of each unit of each stack and the bottom edge of the lower frame of the unit superposed on it, while units which are not supported by their bottom faces are fixed by one or more of their side faces against one or more of the free side faces of units forming the said stacks.

In one particular embodiment the said spacer parts form part of the actual building units and are formed by the ends of the uprights of the units, these uprights being extended beyond the bottom edge of the lower frame and/or beyond the top edge of the upper frame.

In one advantageous form of construction of the building according to the invention, the units, or at least some of them, are equipped with vertical casings installed in the corners of the units, over the entire height of the latter, the respective bottom and/or top horizontal walls being provided with openings at the points where these corner casings terminate at these horizontal walls; the corner casings of one unit are joined by means of suitably shaped ducts to the corresponding corner casings of the units situated above and/or below, so that the corner casings joined together form continuous vertical casings.

These continuous vertical casings, or some of them, may be used as technical casings containing pipes and/or cables.

These continuous vertical casings, or some of them, may also be used as smoke conduits for domestic hearths.

These continuous vertical casings, or some of them, may also be used for carrying air for the ventilation or air conditioning of the rooms.

In one advantageous form of construction of the building according to the invention these continuous vertical casings, or some of them, form part of a radiating thermal conditioning installation which is adapted to provide a suitable temperature inside the building by creating a circulation of air at suitable temperature, in a closed circuit, in the aforesaid continuous vertical casings and in the empty spaces separating the walls of units or of the group of units, these empty spaces being completely isolated by means of partitions from the interior of the units and also from the outside atmosphere; openings provided in the continuous vertical casings establish communication between these casings, at the different levels of the building, and the said empty spaces; continuous vertical casings which have their outlets at the top level of the building are connected to one or more outlet conduits; a number of air return outlets in communication with the empty spaces between the units are installed at the top level of the building, all the return outlets being connected to one or more supply conduits; a fan connected between the supply and outlet conduits ensures circulation of air in a closed circuit, the air being injected into the continuous vertical casings, circulating in the empty spaces between the units, and passing out of these empty spaces through the aforesaid return outlets; the heat exchanger of a heater or of a refrigerating machine is interposed in the circuit downstream or upstream of the said fan.

In one advantageous embodiment the bottom storey of the building according to the invention is provided with one or more technical tunnels in which are installed the cables and pipes serving the building and to which are connected riser pipes and down-pipes serving the various floors of the building, each technical tunnel consisting of a series of units disposed one following the other and resting directly on the foundations.

Other characteristics and advantages of the invention will be clear from the description given below, by way of non-limitative examples, of some particular embodiments of the invention, reference being made to the accompanying drawings, in which.

Figure 29:
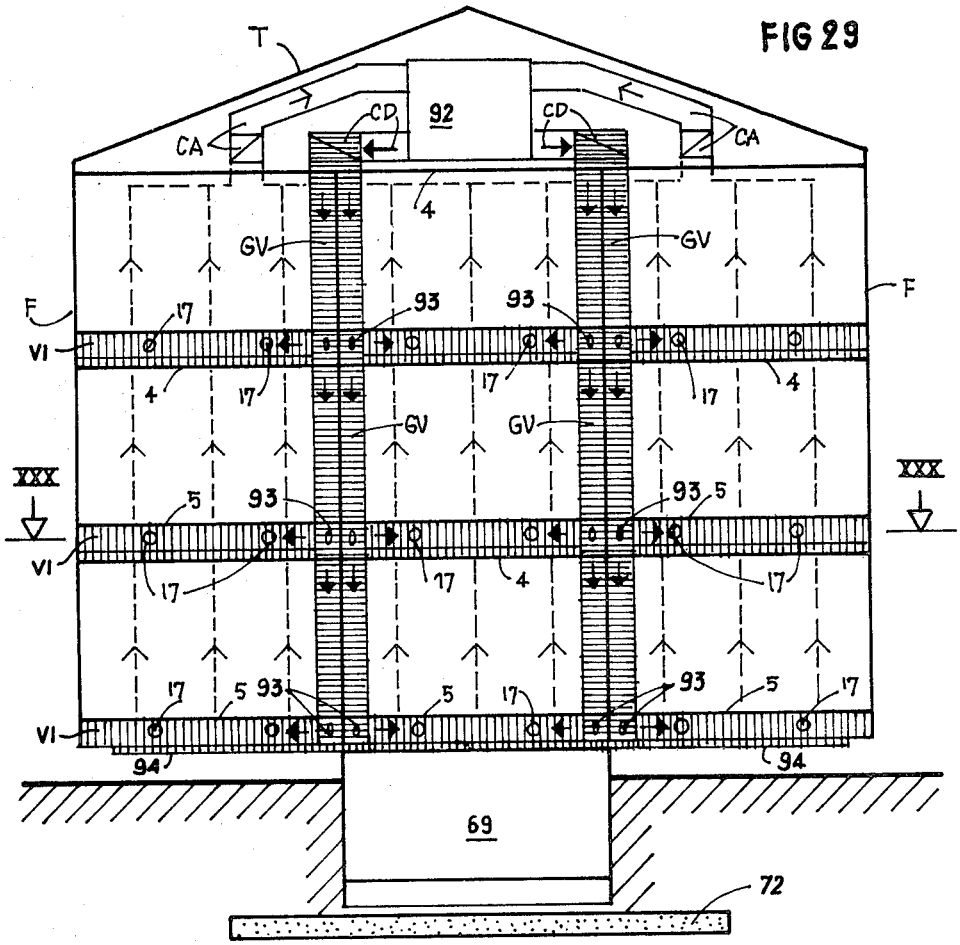
Figure 30:
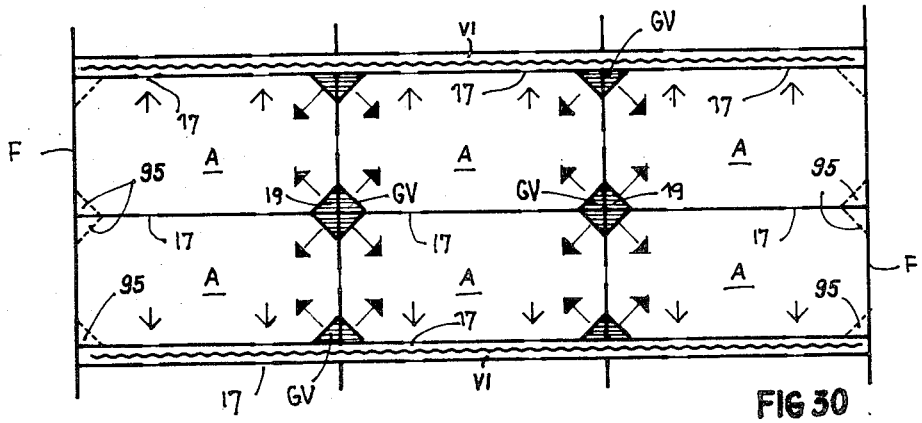

FIGS. 29 and 30 illustrate diagrammatically the circulation of air in a thermal conditioning installation according to the invention. FIG. 29 is a section in a vertical plane perpendicular to a façade of the building. FIG. 30 is a section of a part of the building in the plane XXX—XXX in FIG. 29.

In all these Figures, identical or similar elements are designated by the same reference numerals or letters.

The units shown in FIGS. 1 to 6 and 8 to 18 are made of metal, preferably steel. Other metals could also be used, but are as a rule less advantageous from the point of view of price or from the point of view of mechanical strength.

Figure 19:
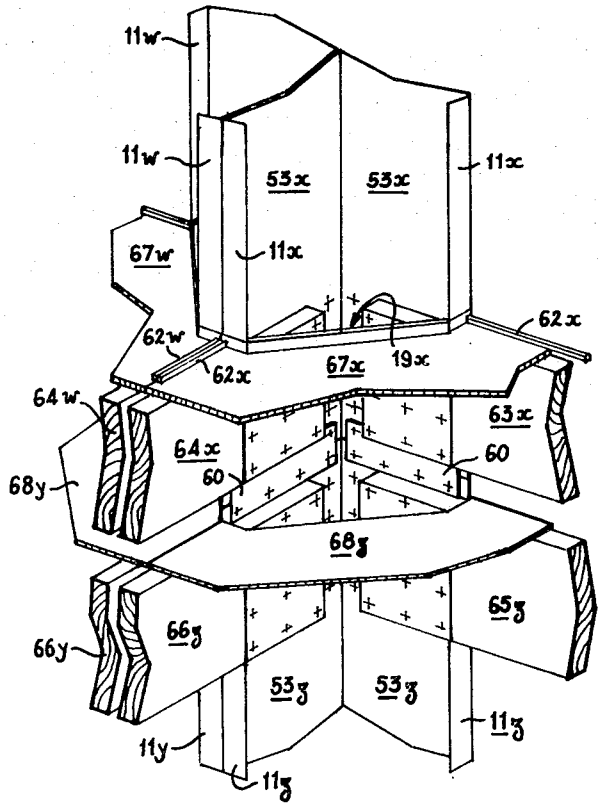
FIG. 19 is a detail view similar to that of FIG. 18; the assembled units are rather similar to those of FIG. 14, but their upper and lower frames and their top and bottom walls are of wood (and not of steel)

It should however be noted that the units according to the invention may also be made entirely of wood or of a combination of wooden elements and steel elements. FIG. 19 illustrates a construction of this kind.

Certain component elements of the units (and in particular the top horizontal walls) may also be made of a reinforced plastics material.

Figure 1:
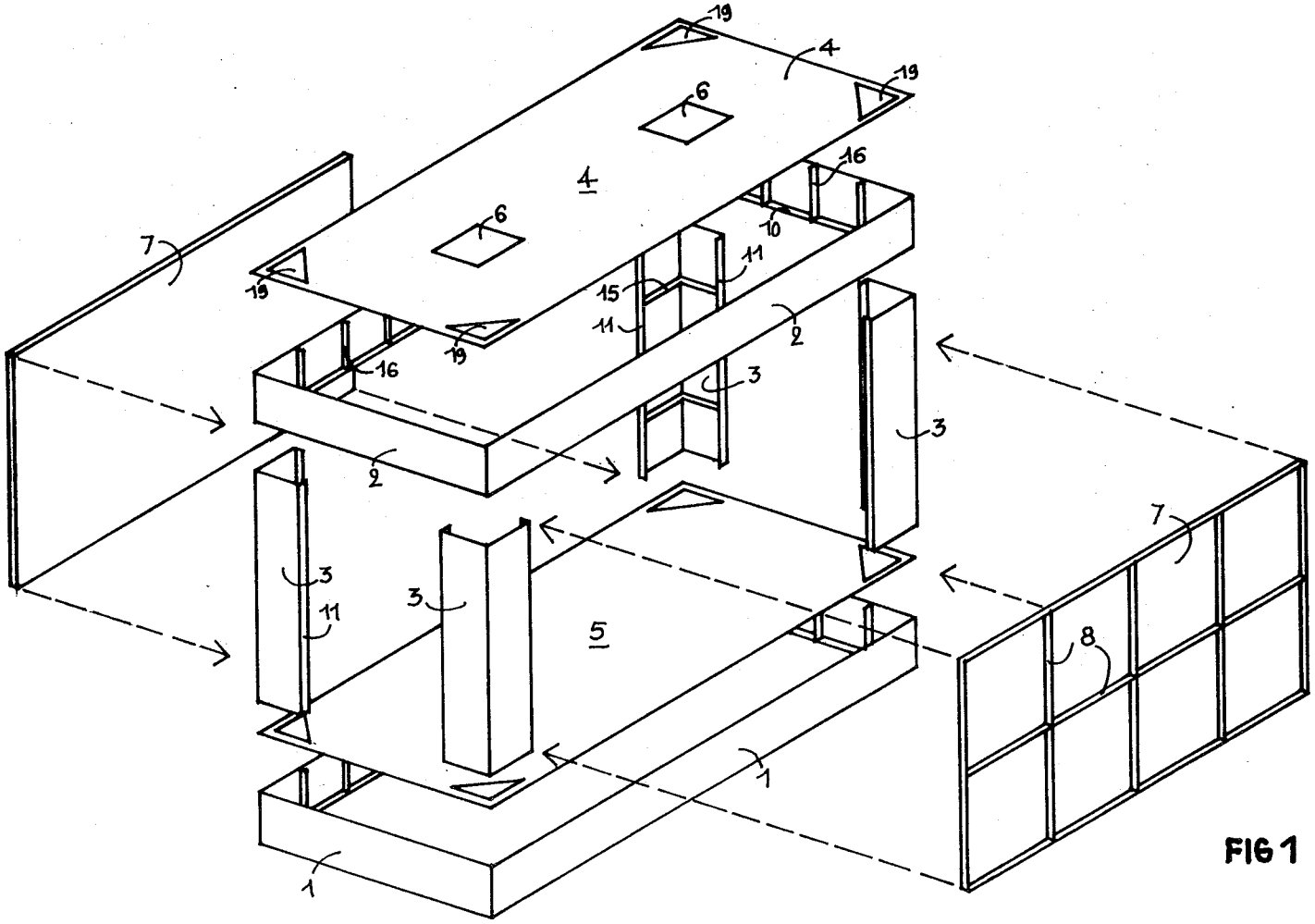
FIG. 1 is an exploded view of a unit according to the invention.

FIG. 1 is an exploded view showing the principal component parts of a unit having a rectangular base, according to the invention. This unit comprises a lower frame 1, an upper frame 2, and four uprights 3.

A unit may in addition comprise a top horizontal wall 4 and/or a bottom horizontal wall 5. As will be seen below, the majority of the units used in the construction of buildings have both a top horizontal wall and a bottom horizontal wall.

It is advantageous for each top horizontal wall to have one or more openings 6 permitting the passage of a man and adapted to be closed by means of removable attached panels.

The various component parts of a unit are made of metal, preferably of steel. Other metals are also suitable, but as a rule are less advantageous from the point of view of price or of their mechanical strength.

Figure 2:
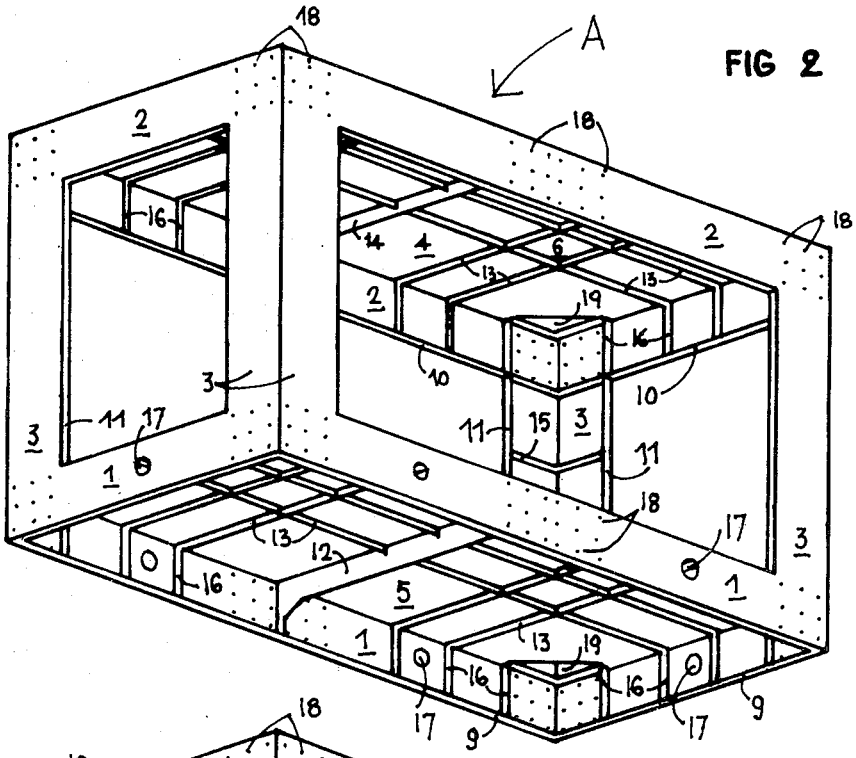
FIG. 2 shows a unit having a rectangular base, shown in isometric projection, viewed obliquely from below.

The joining together of the component parts indicated above forms a unit such as that shown in FIG. 2.

Each lower frame 1 or upper frame 2 may for example be made by joining together, by welding, four strips of wide flat material. Each frame may however also be made with a single weld, with the aid of a single wide piece of flat material folded suitably to form a rectangular frame.

Each upright 3 has a V-shaped section and can be made by welding together at right angles two wide piece of flat material or by folding over at right angles a single wide piece of flat material of double width.

The top wall 4 consists of a metal sheet joined, for example by welding, to the top edge of the upper frame 2.

The bottom wall 5 consists of a metal sheet joined, for example by welding, to the lower frame 1 near the top edge of the latter. However, in a particular embodiment the bottom wall 5 is not disposed level with the top edge of the lower frame 1, but is slightly offset downwards, so that the top part of the lower frame forms above the bottom wall 5 a small projecting edge, for example of a height of the order of 10 mm. The advantages of this special arrangement will be explained below.

FIG. 1 also shows some details of construction (reference numerals 10, 11, 15, 16, and 19), which will be discussed with reference to FIG. 2, which shows a unit constructed by joining together the component parts (reference numerals 1 to 6) enumerated above.

In certain units according to the invention the openings of two opposite side faces are closed by means of reinforcing panels 7 made of heavy steel sheets provided with stiffeners 8. FIG. 1 shows such panels 7 intended to close the openings of the two large side faces of a rectangular unit. These panels 7 are solidly fixed, for example by welding or bolting, to the uprights 3 and to the lower frame 1 and upper frame 2, without extending outwards beyond the side faces of the unit. Such panels 7 are provided mainly in order to reinforce certain units not provided with top and bottom horizontal walls, thus giving greater stiffness to these structures.

It should be noted that the reinforcing panels envisaged here must not be confused with the light partitions which will be referred to later on and which do not substantially reinforce the strength of the units and of the buildings constructed with the aid of the latter.

The unit A shown in FIG. 2 has the form of a right parallelepiped. In this Figure can be seen once again the various component parts 1 to 6 shown in FIG. 1. This Figure also shows that the lower frame 1 is provided at the bottom with a projecting edge 9, that the upper frame 2 is provided at the bottom with a projecting edge 10, and that the vertical edges of the flanges of the uprights 3 are provided with projecting edges 11. All these projecting edges are right angle edges directed towards the interior of the unit.

The large side of the base of the said parallelepiped has a length equal to twice the length of the small side of this base. This particular arrangement offers numerous advantages for the joining of building units to one another, particularly when it is desired to juxtapose units A by fastening two units A by one of their small side faces against one of the large side faces of a third unit A.

The lower frame 1 and upper frame 2, the uprights 3, and the top wall 4 and bottom wall 5 are reinforced by means of stiffeners given the reference numerals 12 to 16; these stiffeners may consist of metal ribs welded against the sheets of wide flat bars which they reinforce; these stiffeners may also consist of metal sections (for example L, U, or C sections) bolted against these metal sheets or wide flat bars.

In the top wall 4 is provided a manhole 6 bounded by stiffeners 13 and adapted to be closed by a detachable panel. A second manhole 6 (disposed for example symmetrically to the first in relation to the stiffener 14) may optionally be provided in the top wall 4.

Holes 17, which in particular permit the passage of pipes or cables, are provided in the lower frame 1 under the level of the bottom wall 5.

In the embodiment illustrated as an example in FIG. 2 each small side of the lower frame 1 is provided with a single hole 17 disposed halfway between the vertical edge of the said frame; each large side of the frame 1 is provided with two holes 17.

The lower frame 1 and upper frame 2 are provided with holes 18 which make it possible for juxtaposed units to be bolted together. In the embodiment shown in FIG. 2 each small face of the unit A is thus provided with four series of nine holes 18 situated near the vertical edges of the building unit. Each large side face of the unit A is provided with eight series of nine holes 18.

It will be noted that the arrangement of the holes 17 and 18 is such that when two units A are placed with one of their small side faces against a large side face of a third unit A (each small side face covering half a large side face) the holes 17 and 18 of the faces in contact will coincide.

In a modified embodiment (not illustrated in FIG. 2), the flanges of the uprights 3 are likewise provided with bolt holes.

Openings 19 of triangular shape are provided in the top wall 4 and bottom wall 5 near each of the four vertical edges of the unit A. A vertical corner casing leading into the said openings 19 can thus be installed along each vertical edge of the unit A (see FIGS. 29 and 30).

A corner casing of this kind is advantageously formed by mounting, parallel to a vertical edge of the unit A, a rectangular wall (not shown in the drawings) fastened by its vertical edges to the projecting edges 11 of an upright 3. This rectangular wall, which occupies the entire height between the floor and the ceiling, thus forms with the upright 3 and a part of the upper frame 2 a corner casing of triangular section. It is generally advantageous to install such corner casings at the four corners of each unit A. However, when these casings are not desired in certain positions, the openings 19 are closed by means of detachable panels.

Figure 3:
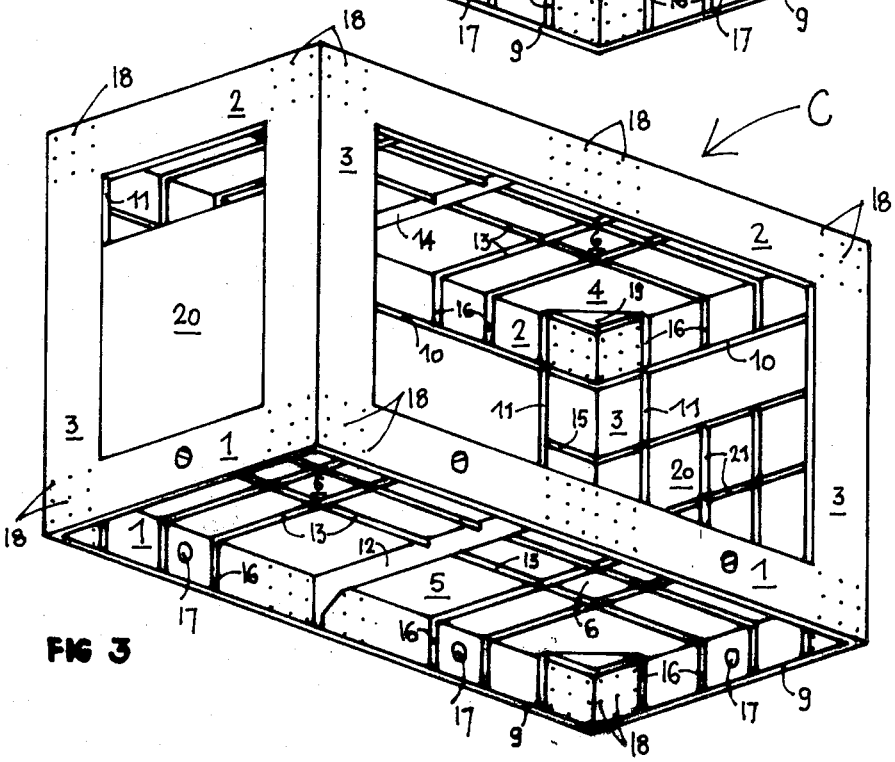
FIG. 3 shows in similar manner a unit having a rectangular base and designed for the formation of technical tunnels in the basement.

The unit C shown in FIG. 3 is designed to be laid directly on a foundation or foundation floor, for example of reinforced concrete, to which it may be anchored by means known per se. The unit C is similar to the unit A shown in FIG. 2, but in the bottom wall 5 two manholes 6 are provided which gives access to the space between the bottom wall 5 and the foundations. These manholes 6 are bounded by stiffeners 13 and can be closed by detachable panels. In addition, the openings of the two small side faces of the unit C are closed over the major part of their height by panels 20 made of heavy metal sheets reinforced by stiffeners 21.

The utilisation of the units C and the reason for the provision of the panels 20 will be explained later on in connection with FIGS. 20 and 22.

In a modified embodiment the two small side faces of the unit C are entirely closed by panels. In another embodiment the two small side faces of the unit C are open and panels close the two large side faces (completely or up to a certain height).

Figure 4:
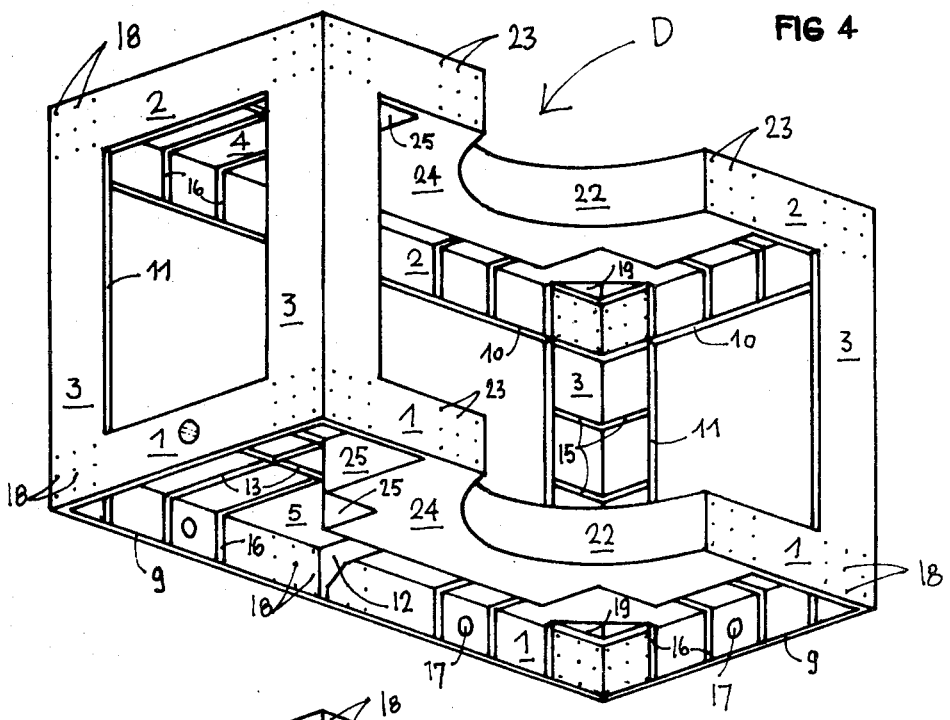
FIG. 4 shows a unit whose top and bottom walls are provided with semi-circular cutouts; this unit is shown in isometric projection, viewed obliquely from below.

FIG. 4 shows a unit D which is designed to permit the installation of a spiral staircase for passage between superposed units. The unit D is comparable with a unit A, but the top wall 4 and bottom wall 5 are each provided with a semicircular cutout.

The semicircular cutout of the bottom wall 5 is situated on the side of one of the large side faces, and its centre is situated halfway between the vertical edges of this large side face. The lower frame 1 is interrupted at the point where this opening is provided. A wide flat bar curved in a semicircle follows the edge of the wall 5 where this cutout is situated. This wide flat bar 22 is joined (for example by welding) to the edge of the wall 5 and also to the lower frame 1 at the points where the latter is interrupted. On each side of the semicircular cutout the lower frame 1 is provided with a series of boltholes 23. The rigidity of the unit D is reinforced in the region of the said cutout by means of a heavy reinforcing sheet 24 which likewise has a semicircular cutout. The sheet 24 disposed horizontally under the wall 5 is connected (for example by welding) to the bottom edge of the lower frame 1 and of the wide flat bar 22. The reinforcing sheet 24 is likewise joined to the bottom wall 5 by means of sheet metal parts 25 disposed vertically and fastened by means known per se to the wall 5 and to the edges of the sheet 24 situated under the said wall 5. A plurality of these sheet metal parts 25 may be fastened in position by welding, but at least one part 25 must be fixed in detachable manner (for exmple by bolting) in such a way as to permit access to the bolt holes 23 on the inner side of the lower frame 1.

The semicircular cutout in the top wall 4 is situated vertically in line with that in the bottom wall 5. Around this cutout in the wall 4 are disposed the same elements 22 to 25, arranged and joined in similar manner.

When two units D are joined side by side in suitable manner, the semicircular cutouts complement one another to form circular openings permitting the installation of a spiral staircase for passage between superposed units D.

For the bottom and top levels of a spiral staircase, units are provided which are comparable with the unit D but in which only the top wall or bottom wall is provided with a semicircular cutout. The bottom part or the top part of the unit is then as in a unit A.

In the same way as the units A, units C and D can be equipped with corner casings.

Figure 5:
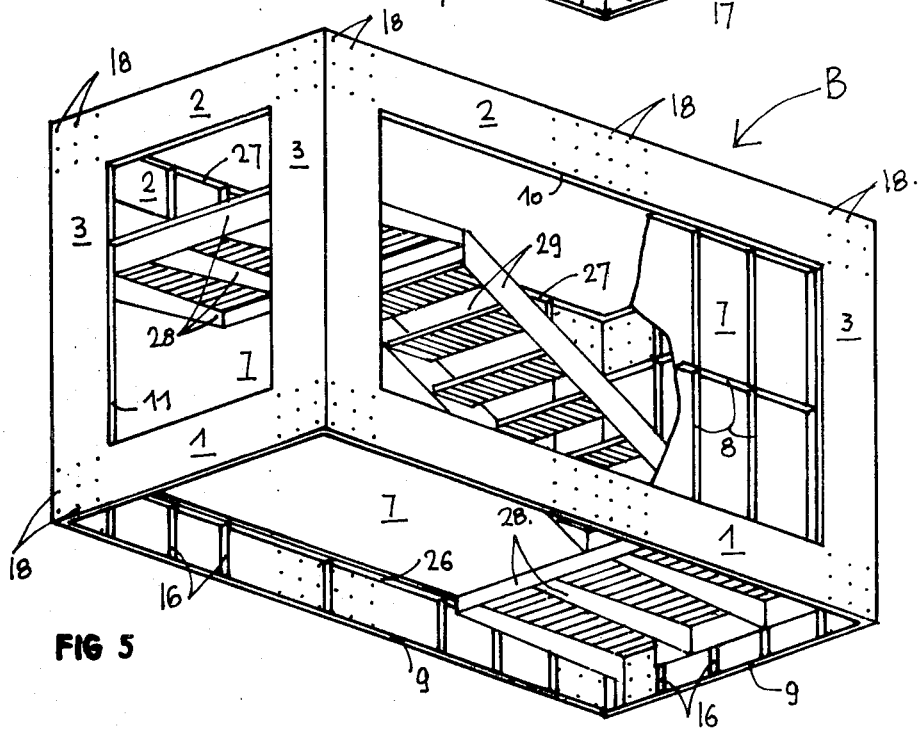
FIG. 5 shows in similar fashion a unit equipped with a flight of stairs and with landings.

FIG. 5 shows a unit B designed principally for receiving an arrangement intended for the vertical circulation of persons or objects between the various storeys of a building. In the example shown in FIG. 5 a staircase is installed in the unit B. A stack of units B then forms a staircase well, but it should be understood that a stack of units B may also be used as a lift or elevator well.

Like the unit A, the unit B comprises a lower frame 1, an upper frame 2, and four uprights 3, but it has not top and bottom floors.

Over its entire internal periphery the lower frame 1 is provided with a stiffener 26 situated near its top edge. This stiffener 26 is situated at the level where the bottom wall 5 is located in a unit A.

At the top the upper frame is provided with a projecting edge 27 directed at right angles inwards.

The two large side faces of the unit B are closed by means of reinforcing panels 7 made of heavy steel sheets provided with stiffeners 8. These panels 7 are strongly fastened, for example by welding or by bolting, to the projecting edges of the uprights 3 and of the lower frame 1 and upper frame 2, and thus contribute to the rigidity of the unit B. In Figure 5 one of the two panels 7 is shown partly broken away.

Units are also provided which are comparable to the unit B, but which are provided either with a bottom wall (identical to the wall 5 of unit A) or with a top wall (identical to the wall 4 of unit A). Units of this kind are used for the top or bottom storey of a staircase well or lift or elevator well.

When a stack of units B is used as staircase well, prefabricated landings 28 are installed therein, for example by bolting or by welding. Between the landings 28 are fixed prefabricated flights of stairs 29 (two per storey). The small side face of the unit B, which is situated on the side of a halfway landing, is closed by means of an attached panel (not shown).

Figure 6:
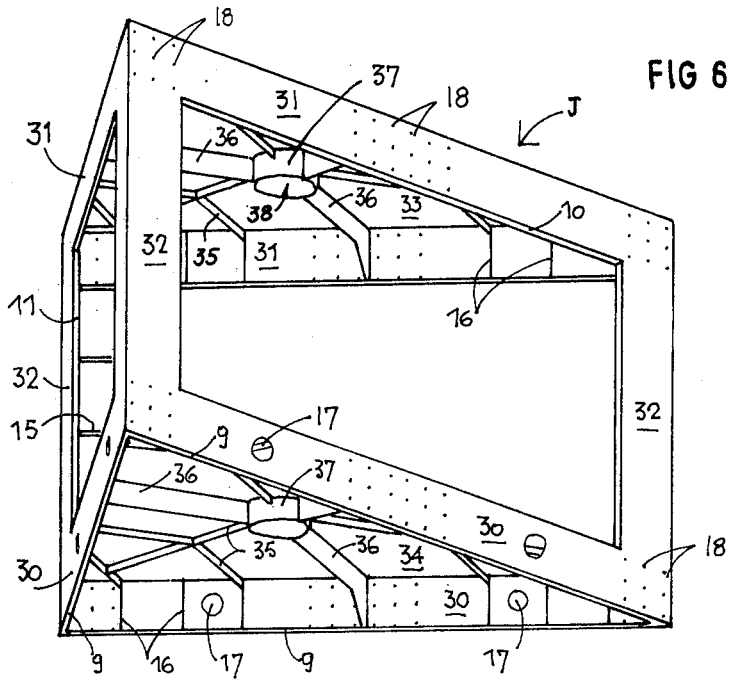
FIG. 6 shows in similar fashion a unit having a triangular base and provided with top and bottom horizontal walls.

The unit J shown in FIG. 6 has the shape of a right prism whose base is an equilateral triangle. The structure of a unit J is similar to that of a unit A.

A unit J comprises a lower frame 30, an upper frame 31, three uprights 32, a top wall 33, and a bottom wall 34; the uprights 32 have a V-shaped section the sides of which form together an angle of 60°. The lower frame 30 is provided at the bottom with a projecting edge 9, the upper frame 31 is provided at the bottom with a projecting edge 10, and the vertical edges of the flanges of the uprights 32 are provided with projecting edges 11. All these projecting edges are directed at right angles towards the interior of the unit J.

The lower frame 30 and upper frame 31, the uprights 32, and the top wall 33 and bottom wall 34 are reinforced by means of stiffeners given the reference numerals 15, 16, 35, 36, and 37. In the top wall 33 is provided a manhole 38 bounded by the stiffener 37 of circular shape; each side face of the unit J is identical to a large side face of a unit A and is provided with two holes 17 permitting the passage of pipes or cables, and with eight series of bolt holes 18.

FIGS. 1 to 6 illustrate only some of the units according to the invention, shown as non-limitative examples.

Figure 7:
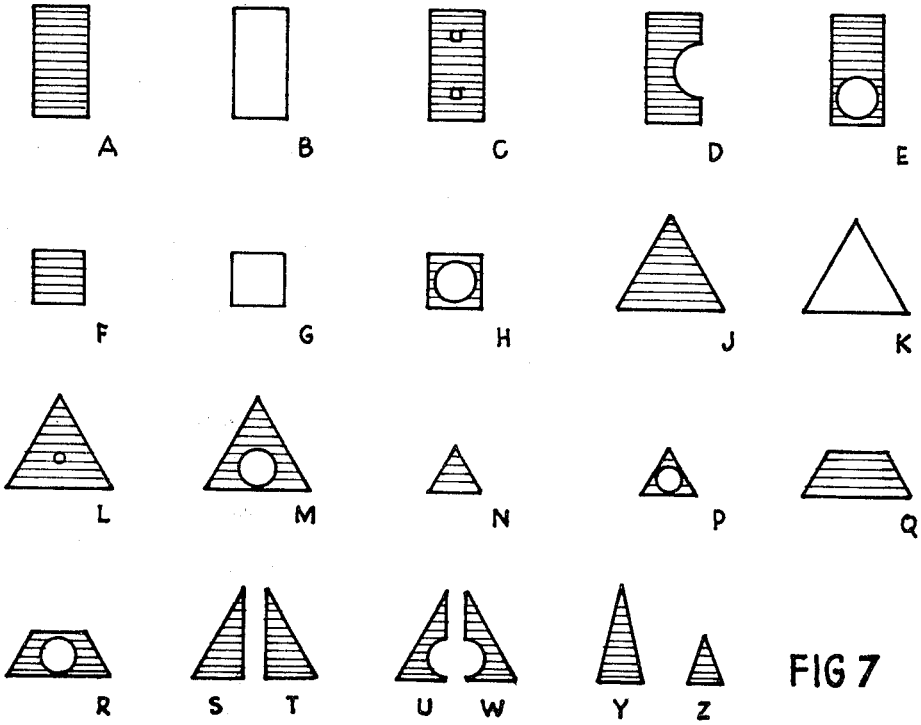
FIG. 7 shows diagrammatically various forms of units according to the invention, shown in plan and on a small scale.

FIG. 7 shows diagrammatically various shapes of units according to the invention, shown in plan on a small scale. Most of the units shown in FIG. 7 are not illustrated or described in detail, but their structure is similar to that of the units previously described.

All the units shown in FIG. 7 have the shape of a right prism, and according to one advantageous embodiment of the invention all these prisms are of the same height; furthermore, at least two sides of the base of these prisms have a length which is equal to a reference length common to all the units, or to a multiple of this reference length. The height of each prism is for example 3,075 mm and the said "reference length" is 2,250 mm. These dimensions are obviously given by way of example without limitation.

All these units comprise a lower frame, an upper frame, and uprights joining together the said lower and upper frames. The shape of these frames obviously corresponds to the shape of the base of the prism; the uprights have once again a V-shaped section, and each upright is disposed in such a manner that its edge forms a vertical edge of the prism and that its flanges are oriented along the side faces of the prism. Certain units have in addition bottom and top walls; in FIG. 7 such units are shown hatched.

The units A, B, C, D, and E all have a base of rectangular shape, the small side of this base having a length equal to the "reference length"; the length of the large side of the base is equal to twice the said "reference length". The units A, B, C, and D have been described above with reference to FIGS. 1 to 5.

The unit E is similar to unit A, but in its top and bottom walls it has a circular opening permitting the installation of a spiral staircase for passage between superposed building units.

Units F, G, and H are respectively similar to units A, B, and E, but they have a square base whose sides have a length equal to the "reference length".

Units J, K, L, and M all have a base in the shape of an equilateral triangle whose sides have a length equal to twice the "reference length".

Unit J has been described above with reference to FIG. 6.

Unit K is fairly similar to unit J, but it has no top wall or bottom wall. Its lower frame 30 is provided over its entire inner periphery, with a stiffener 26 situated near its top edge. Its upper frame 31 is provided at the top with an edge 27 projecting at right angles and directed towards the interior of the frame 31.

The unit L is designed to be laid directly on a foundation or foundation floor; the unit L is very similar to unit J, but in its bottom wall it has one or more manholes which give access to the space between the bottom wall 5 and the foundations.

The unit M is likewise similar to unit J, but in its top and bottom walls circular openings are provided, which permit the installation of a spiral staircase for passage between superposed building units.

Units N and P likewise have a base in the form of an equilateral triangle; however, the sides of this base have a length equal to the "reference length". Otherwise, units N and P are respectively similar to units J and M.

The units Q and R have a base in the form of an isosceles trapezium of which three sides have a length equal to the "reference length", while the fourth side has a length equal to twice this "reference length". Otherwise, units Q and R are similar to units J and M, that is to say the unit Q has top and bottom walls and the unit R has top and bottom walls in which circular openings are provided for the installation of a spiral staircase.

The units S and T have a base in the form of a right-angled triangle whose shortest side has a length equal to the "reference length", while the hypotenuse has a length equal to twice this "reference length". Otherwise units S and T are similar to unit J.

Units U and W are similar to units S and T, but their top and bottom walls are provided with a semicircular cutout. These semicircular cutouts are situated on the side forming the larger of the two side faces defining between them a right angle.

The structure of the units U and W is comparable to that of unit D, and can easily be understood by referring to FIG. 4. It will be understood that joining together a unit U and a unit W, juxtaposed in suitable manner, will form a structure comparable to a unit M.

The units Y and Z have a base in the shape of an isosceles triangle. Otherwise, these units have a structure similar to the unit J. The unit Y has a base in the shape of an isosceles triangle in which the two equal sides have a length equal to twice the "reference length". The third side of the triangle has a length which can be selected in accordance with construction requirements. In one particular embodiment this third side has a length equal to the "reference length".

The unit Z has a base in the shape of an isosceles triangle in which the two equal sides have a length equal to the "reference length". The third side may be selected in accordance with requirements.

The series of units shown in FIG. 7 is not exhaustive. Other shapes of units can easily be conceived. The units may be joined together in very numerous combinations, thus making it possible to construct the most diversified buildings.

It is by no means necessary to have available all of the units shown in FIG. 7 in order to construct a building. The units A, B, and C alone will already be sufficient to make numerous types of buildings.

For the prefabrication of the units the same parts are used in the production of a number of different units. Thus, all the uprights of units A to H are identical. The same is true for units J to P.

In a preferred embodiment the units are produced by joining together, by known means, elements which have been prefabricated in the factory.

Figures 8, 9, 10:
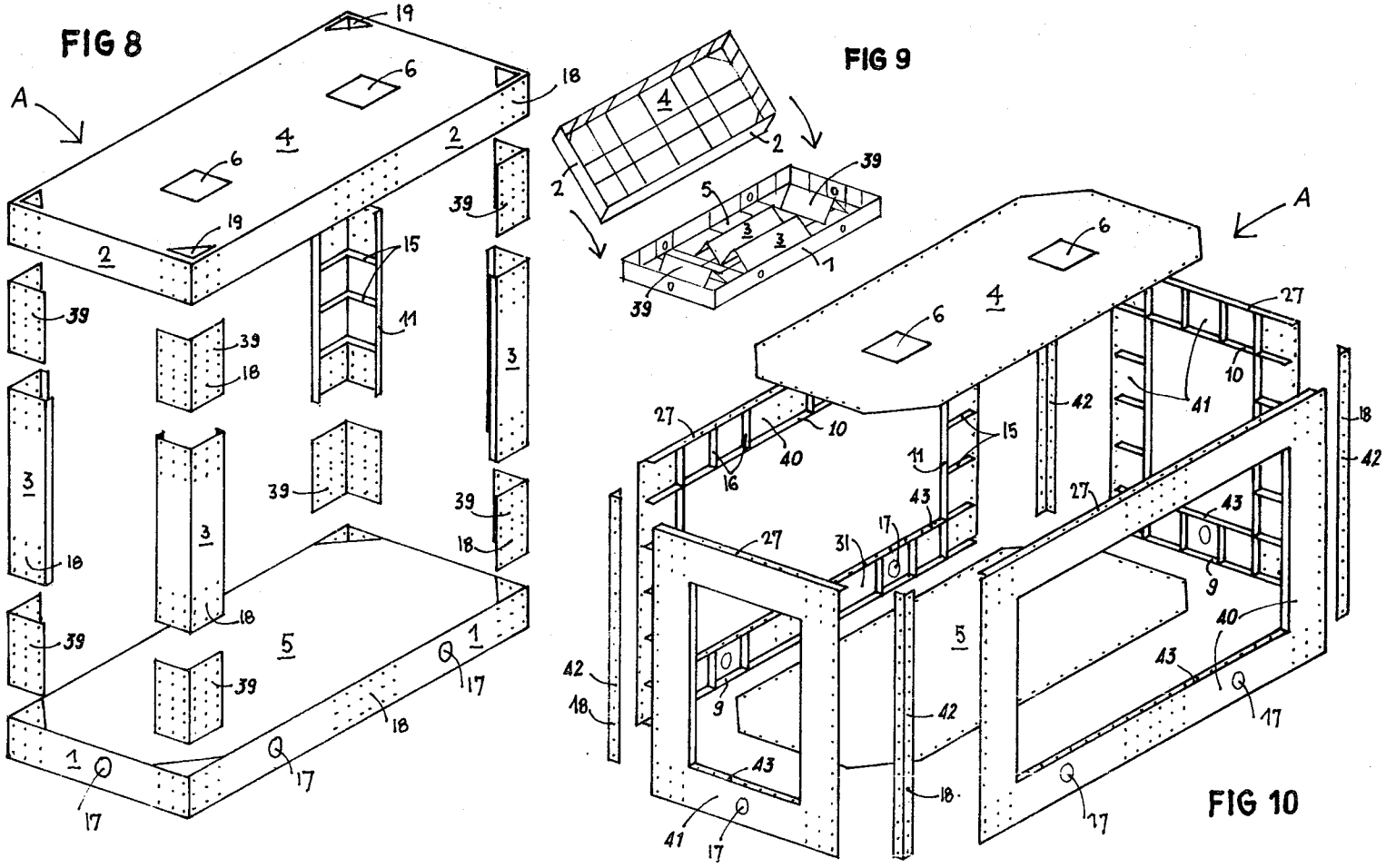
FIG. 8 is an exploded view showing prefabricated parts whose assembly by bolting makes it possible to form a unit similar to that shown in FIG. 2.
FIG. 9 illustrates an advantageous manner of stacking the component parts of the unit shown in FIG. 8 for the purpose of storage and transport.
FIG. 10 is another exploded view showing other prefabricated parts whose assembly by bolting permits the formation of a unit similar to that shown in FIG. 2.

By way of example, FIG. 8 shows the prefabricated elements the joining together of which by bolting permits the construction of a unit A similar to that shown in FIG. 2.

These prefabricated elements comprise:

A bottom part comprising a frame 1 and a wall 5;

A top part comprising a frame 2 and a wall 4;

Four uprights 3;

eight angles 39 enabling the uprights 3 to be joined to the bottom and top parts; these angles 39 are placed on the inside of the frames and uprights.

In order to permit joining together by bolting, the uprights 3 are provided at each end and on each flange with a series of nine bolt holes 18, and the angles 39 are provided with thirty-six bolt holes.

In each series of nine holes 18 situated near the corners of the frames 1 and 2, and in each series of nine holes 18 in the uprights 3, a single hole 18 (for example the hole at the centre in each series) is countersunk on the outer side of the unit A.

For assembly on the worksite the elements of the unit A are first joined together by using a bolt having a countersink head for each countersunk hole. In this way no bolt heads will project beyond the side faces of the unit A. The joint thus made is sufficiently strong to enable the unit to be lifted by a crane and placed in the position which it is to occupy in a building under construction.

Figure 12:
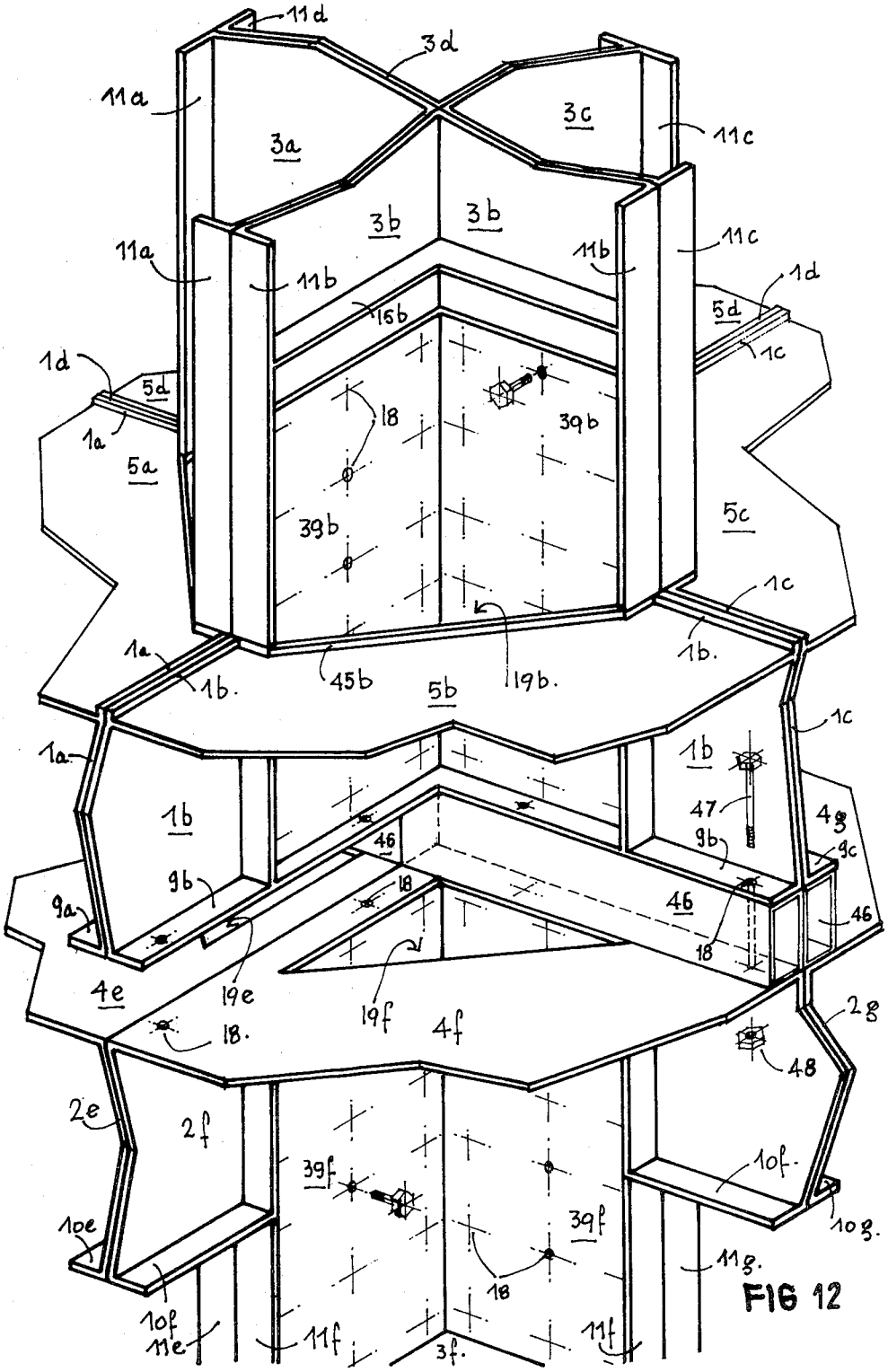
FIG. 12 is a detail view on a larger scale (with parts broken away) showing the system of assembly of the units, at the meeting point of four units (of the type illustrated in FIG. 8) superposed, with the interposition of spacers, on four other units of the same type.

When a plurality of units are juxtaposed in one and the same storey of the building, the bolt holes 18 remaining free are then used for bolting together the juxtaposed units (see FIG. 12).

FIG. 9 illustrates a very advantageous manner of stacking the component parts of a unit A of the type illustrated in FIG. 8, for the purpose of storage and transport. The bottom part of the unit A is turned upside down so as to form a flat metal container in which are placed the four uprights 3 and the eight angles 39; a box of bolts and nuts and other accessories necessary for the construction of the building can also be placed in this container; the top part of the unit A is placed over the bottom part after the style of a lid, thus forming a container which can easily be stored or transported. For road transport three or four of these containers can be stacked on a lorry.

All the building units according to the invention can be formed by joining together factory-prefabricated elements, in a similar manner to that illustrated in FIG. 8, and for most of these units the component parts can be stacked in a similar manner to that illustrated in FIG. 9.

FIG. 10 illustrates another example of the production of a unit A by joining together factory-prefabricated elements.

In this case, the prefabricated elements comprise:

Two large vertical frames 40 forming the large side faces of the unit;

Two small vertical frames 41 forming the small side faces of the unit;

Four angles 42;

A top wall 4 and a bottom wall 5.

In order to enable them to be joined together by bolting, the vertical frames 40 and 41 and the angles 42 are provided with bolt holes 18 and at the top are provided with a projecting edge 27 which permits the fastening by bolting of the top wall 4. The bottom wall 5 is bolted on horizontal stiffeners 43 carried by the bottom part of the vertical frames 40 and 41. These stiffeners are slightly offset in the downward direction in relation to the top edge of the bottom part of the frames 40 and 41.

In a modified embodiment the stiffeners 43 are situated flushed with the top edge of the bottom part of the frames 40 and 41 (thus forming edges projecting at right angles). In this case the wall 5 is provided with small edges projecting at right angles in the upward direction. These small projecting edges consist for example of small metal ribs welded or screwed along the edges of the wall 5. When the unit is assembled and the wall 5 is bolted to the stiffeners 43, these small projecting edges are situated in line with the sheets forming the vertical frames 40 and 41.

It will be understood that all the prefabricated elements shown in FIG. 10 can easily be stacked for storage or transport.

All the building units according to the invention can be made by assembling prefabricated elements in a similar manner to that illustrated in FIG. 10.

Figure 11:
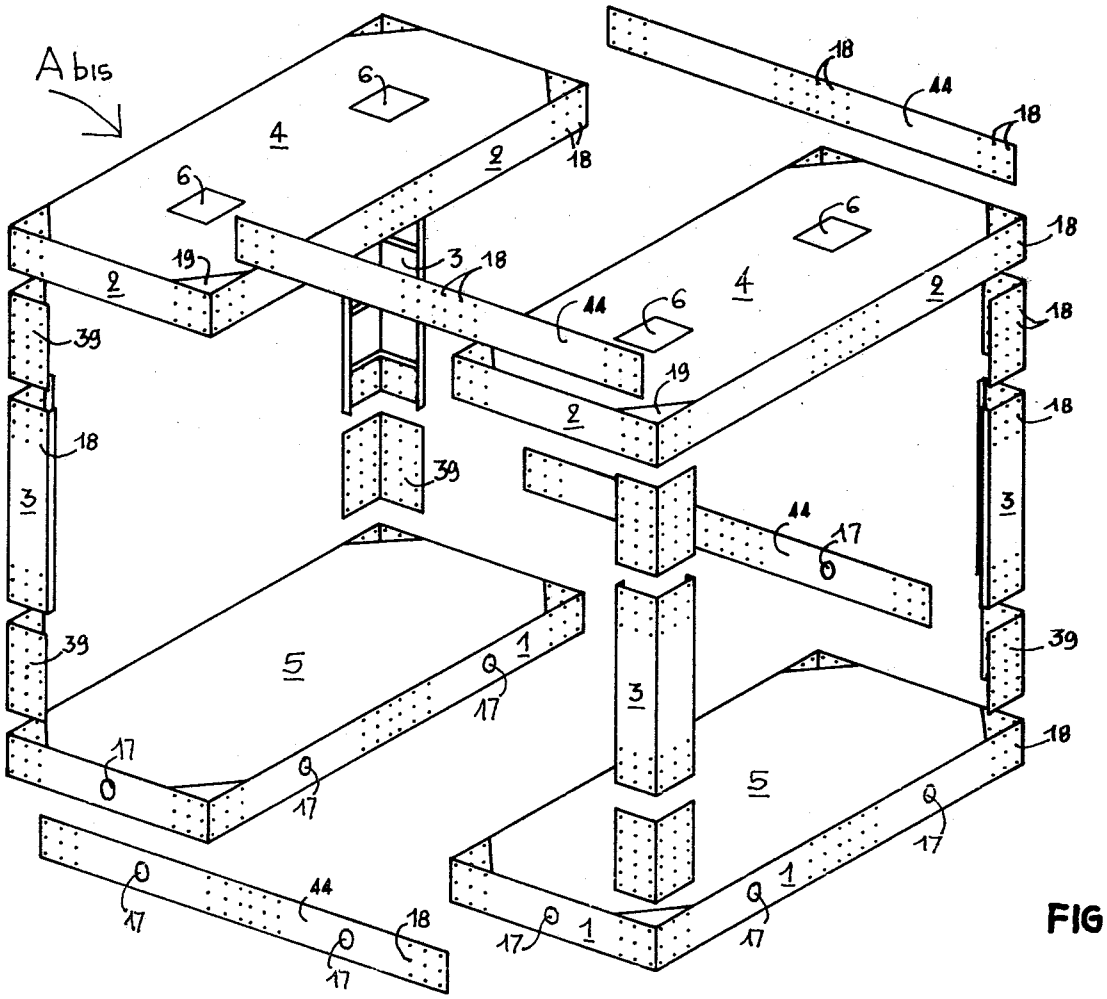
FIG. 11 is an exploded view showing the prefabricated parts (similar to those used for forming the unit shown in FIG. 8), whose assembly by bolting permits the construction of a large unit having a square base.

FIG. 11 shows the prefabricated parts whose assembly by bolting makes it possible to form a large unit A bis having a square base; the bottom part of this unit A bis is formed by two parts, each of which corresponds to a bottom part of a unit A (of the type shown in FIG. 8). These two parts are joined together side by side with the aid of thirty-six bolts. The top part of the unit A bis is formed in the same way by joining together two parts, each of which corresponds to a top part of a unit A (of the type shown in FIG. 8).

Just as in the case of a unit A, the connection between the uprights 3 and the bottom and top parts is made by bolting, with the aid of angles 39. The rigidity of the unit A bis is increased by means of four wide flat bars 44 provided with bolt holes 18. Each wide flat bar is bolted against the outer face of two small sides of the frame 1 (or frame 2), which it thus joins together.

For the construction of a multistorey building a plurality of units according to the invention may optionally be stacked direct one on the other. In this case two superposed units are fastened together by means of bolts which pass through bolt holes 18 provided for the purpose in the projecting edge 9 of the bottom frame and in the projecting edge 27 of the top frame (or in the top wall 4). This method of procedure is however exceptional, because, as will become clear in the continuation of the present description, it is generally advantageous for the superposed unit to rest on one another with the interposition of spacers. An assembly of this kind is illustrated in FIG. 12, which is a detail view on a larger scale (with parts broken away), showing the system of assembly of the units at the meeting point of eight units A (of the type shown in FIG. 8), four units A (Aa, Ab, Ac, and Ad) being superposed, with the interposition of spacers, on four other units A (Ae, Af, Ag, and Ah). The unit Aa is situated above a unit Ae, the unit Ab is situated above the unit Af, the unit Ac is situated above the unit Ag, and the unit Ad is situated above the unit Ah. In order to facilitate the understanding of the drawing, each element shown is given its reference numeral followed by the reference letter corresponding to the unit to which it belongs. Thus, for example, the bottom wall of the unit Ab will be called **5*b*, and the top wall of the unit Af will be called 4*f*. It should be noted that no element of the unit Ah is visible in FIG. 12**.

It may be observed that the uprights 3 of four juxtaposed units A form together a single pillar having the shape of a potent cross.

Near the opening **19*b* a rib 45*b* is welded against the top surface of the wall 5*b*. The bottom walls 5 of all the units are provided with such ribs 45 near each opening 19. The ribs 45 and the projecting edges formed by the frames 1 above the walls 5 offer numerous advantages. In particular, they prevent any liquids spread over the top surface of a wall 5 from penetrating into the corner casings or between the juxtaposed frames 1. The ribs 45 form support points for the fastening of the panels constituting the corner casings. The projecting edges formed by the frames 1 above the walls 5** constitute supports which are particularly suitable for the installation of panels of any type (generally light partitions) which close the openings between juxtaposed units.

Spacers 46 are interposed between the superposed units A. These spacers 46 consist of hollow sections (of metal) of rectangular section, and they are placed between the projecting edge 9 of one unit and the outer edge of the wall 4 of the unit A situated underneath. Spacers 46 may thus be disposed over the entire periphery of the units A. In another embodiment, spacers 46 are however inserted between superposed units only near the four corners of these units. The bottom and top faces of the spacers 46 are provided with bolt holes which correspond with the bolt holes provided in the projecting edges 9 and the walls 4 of the units A. The superposed units A can thus be secured to one another by means of threaded rods 47 and nuts 48.

In one advantageous embodiment soundproofing jointing, which at the same time effects the distribution of loads, is interposed between the contact surfaces of units joined to one another. Jointing of this type may in particular be interposed under and/or above the spacers 46.

Figure 13:
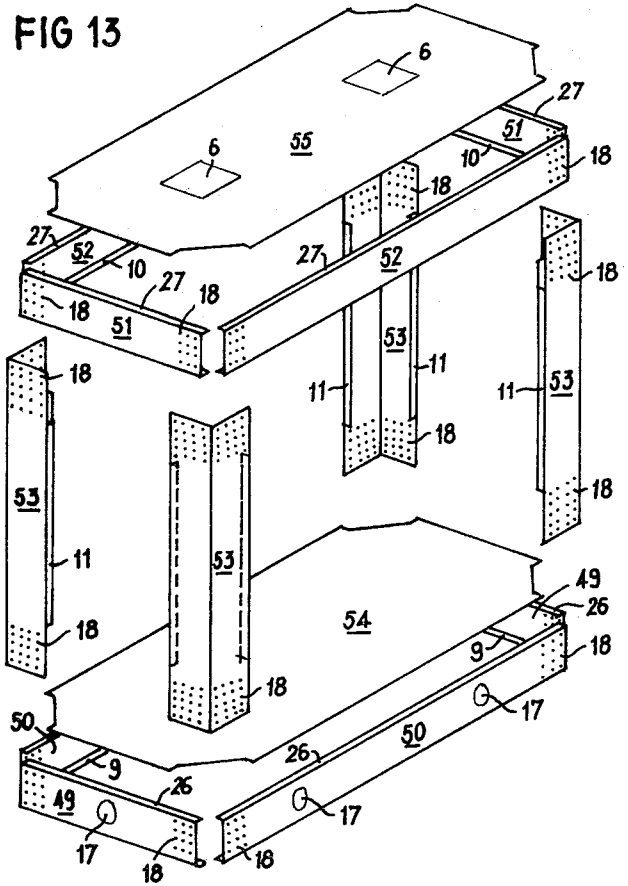
FIG. 13 is an exploded view (similar to those of FIGS. 8 and 10) showing other prefabricated parts whose assembly permits the formation of a unit similar to that shown in FIG. 2.

FIG. 13 illustrates another example of construction of a unit A (slightly different from those shown in FIGS. 2, 8, and 10) by joining together elements prefabricated in the factory. In this case the prefabricated elements comprise:

Two elements 49 and two elements 50, which together form the "lower frame" of the unit;

Two elements 51 and two elements 52, which together form the "upper frame" of the unit;

Four uprights 53;

One bottom horizontal wall 54;

One top horizontal wall 55.

The elements 49, 50, 51, and 52 are U-sections whose two short parallel branches constitute respectively projecting edges 9 and 26 (for the elements 49 and 50) or projecting edges 10 and 27 (for the elements 51 and 52). In the elements 49 and 50 holes 17 are formed, which in particular permit the passage of pipes or cables.

The uprights 53 consist of steel angles. The vertical edges of the flanges of the uprights 53 are provided with projecting edges 11 directed at right angles towards the interior of the unit A. These projecting edges 11 may be formed by folding over the vertical edges of the flanges of the uprights 53, but they may also be formed by welding a small angle along each vertical edge of the uprights 53 (against the face of these flanges which forms the internal angle of the angle).

Figure 14:
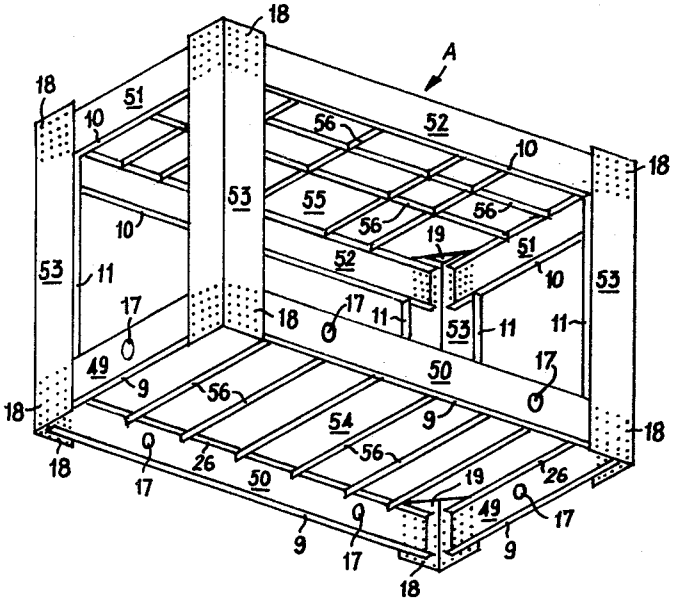
FIG. 14 shows this unit after the assembly of its component elements; this unit is shown in isometric projection, viewed obliquely from below.

The bottom horizontal wall 54 and top horizontal wall 55 are steel sheets made by cutting off the four corners of rectangular steel sheets, in such a manner as to form openings 19 near each of the four vertical corners of the unit A when the various elements are assembled to form this unit (see FIG. 14).

The bottom wall 54 is welded to the projecting edges 26 of the "lower frame" formed by the elements 49 and 50, but it projects beyond the outer side faces of this frame, forming (in relation to these side faces) small projecting edges the width of which is equal to the thickness of the flanges of the uprights 53.

The top wall 55 is similarly welded to the projecting edges 27 of the "upper frame".

The elements 49, 50, 51, and 52 and the uprights 53 are provided near their ends with a series of bolt holes 18 which make it possible to join together (by bolting) the various component elements in order to form the unit A as shown in FIG. 14, and which also enable the juxtaposed units A to be bolted together.

It should be noted that the flanges of the uprights 53 take up position against the outer face of the "lower and upper frames".

When the unit A is constructed, as shown in FIG. 14, the ends of the uprights 53 project beyond the bottom edge of the "lower frame" (elements 49 and 50) and beyond the top edge of the "upper frame" (elements 51 and 52). The projecting portion of these uprights 53 is provided with at least one row of holes 18. The edges of the bottom wall 54 and top wall 55 are situated in alignment with the outer faces of the uprights 53. It should be noted that the ends of the compound elements of the "lower frame" (elements 49 and 50) are not in contact with one another. This "lower frame" is therefore interrupted at each of its corners. The same is true of the "upper frame".

Stiffeners 56 are welded against the lower face of the bottom wall 54 and top wall 55. These stiffeners 56 preferably consist of U-sections (or C-sections) whose open side is disposed downwards.

Figure 15:
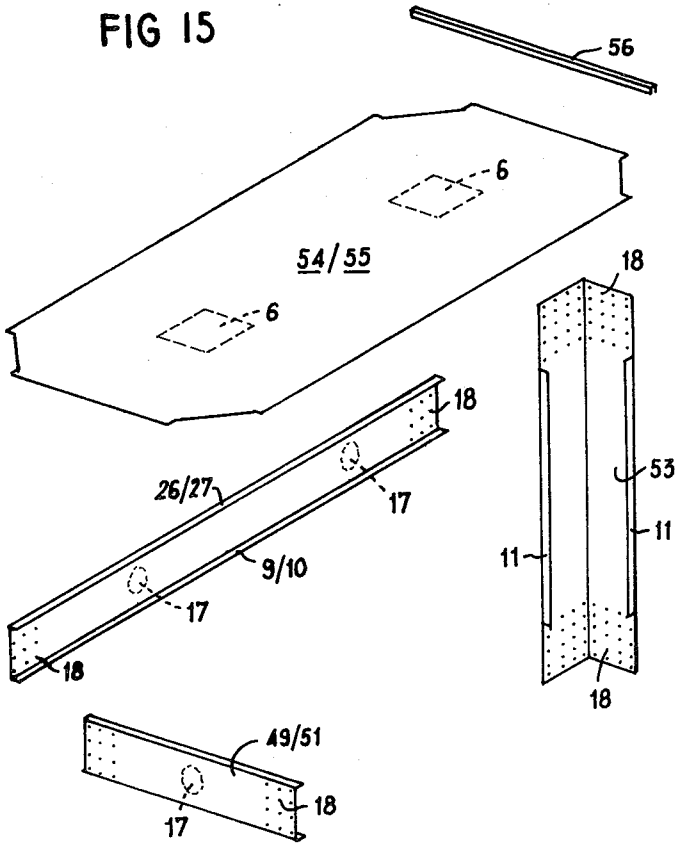
FIG. 15 shows the five types of structural elements used for producing the units of the type shown in FIG. 14.

The unit A shown in FIG. 14 is therefore produced with very simple, inexpensive metal elements. In addition, only a very small number of different elements is used. These elements, which are shown in FIG. 15, comprise in fact:

(1) The elements 49, 50, 51, and 52 which are all obtained from one and the same type of metal U-section. In order to form the large and small sides of the "lower and upper frames" this U-section is simply cut to length and bolt holes 18 are drilled in it. Moreover, the elements 49 and 50 also have holes 17 drilled in them.

(2) The uprights 53, which are all identical and which are obtained by cutting up one and the same type of section. Holes 18 are drilled in the uprights 53. Two methods of manufacture may in fact be used, since it is possible to start either with a metal section which is a wide angle provided with projecting edges 11, or with a simple wide angle (without projecting edges) and two small identical angles which are welded along the edges of the flanges of the wide angle so as to form the projecting edges 11.

(3) The bottom wall 54 and top wall 55, which are obtained by cutting metal sheets. The starting material comprises rectangular sheets, from which the four corners are cut off. For the top wall 55 openings 6 are also cut out.

(4) The stiffeners 56, which are all obtained by cutting off from one and the same U-section (or optionally a C-section).

The sections which form the "upper and lower" frames, the uprights 53, and the stiffeners 56 may all be produced by the cold rolling of flat bars or wide flat bars.

The bottom part of the unit A is formed by welding together elements 49, 50, 54, and 56. The top part of the unit A is formed similarly with elements 51, 52, 55, and 56.

The unit A is then formed by bolting together the bottom part, the top part and the four uprights 53. It is generally advantageous for this assembly by bolting not to be carried out in the factory producing the prefabricated elements, but at the building site or near that site. The bottom and top parts and the uprights 53 can in fact very easily be stacked, so that all the component elements of the unit A then take up very little space.

Figure 16:
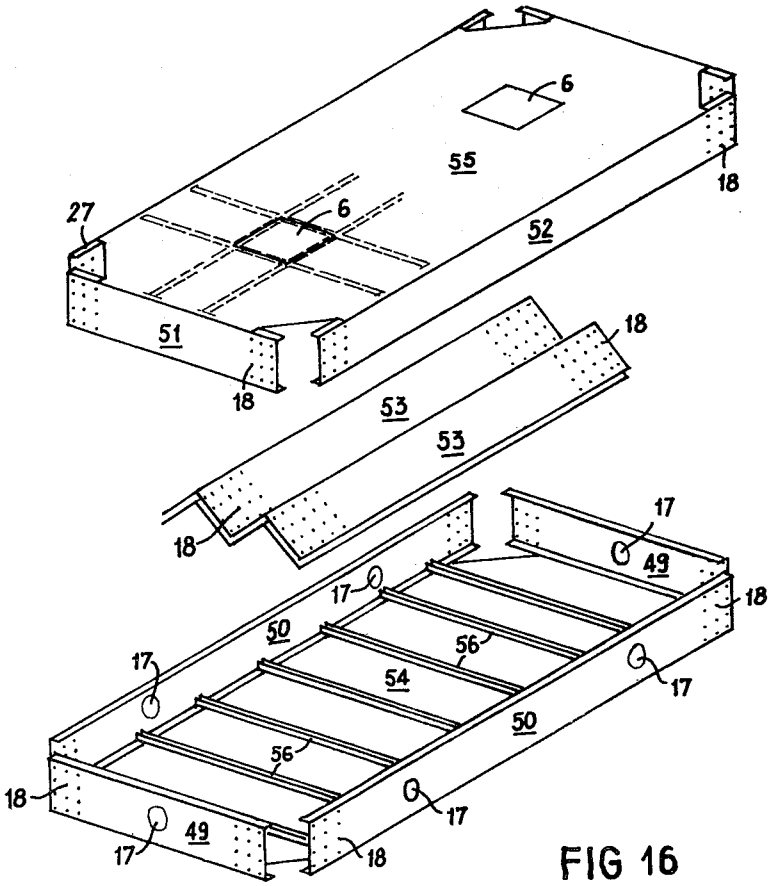
FIG. 16 illustrates an advantageous manner of stacking the component parts of the unit shown in FIG. 1 for the purpose of storage and transport.

FIG. 16 illustrates a very advantageous manner of stacking the component parts of a unit A of the type shown in FIG. 14, for the purpose of storage and transport. The bottom of the unit A is turned upside down so as to form a flat metal container, in which the four uprights 53 are placed; a box of bolts and nuts and other accessories required for the construction of the building may also be placed in this container; the container is then closed by means of the top part, which serves as a kind of lid. Because the "bottom and top frames" are interrupted at their corners, the bottom and top parts can be nested one in the other. The component elements of the unit A stacked in this manner form a kind of container, which can easily be stored or transported. The height of this container is only slightly greater than the height of a "frame", so that for road transport five or six of these containers can be stacked on a lorry.

In order to enable the bottom and top parts of the unit A to fit one into the other, it is not necessary for the "upper and lower frames" to be interrupted at the four corners. In a modified embodiment the "upper and lower frames" are each interrupted at only one of their corners. In another modified embodiment the "lower frame" is complete, that is to say it is not interrupted at any of its corners, while the "upper frame" is interrupted at two opposite corners.

All the building units according to the invention can be produced similarly to the arrangement illustrated in FIGS. 13 and 14, and for most of these units the component parts can be stacked in a similar manner to that illustrated in FIG. 16.

Figure 17:
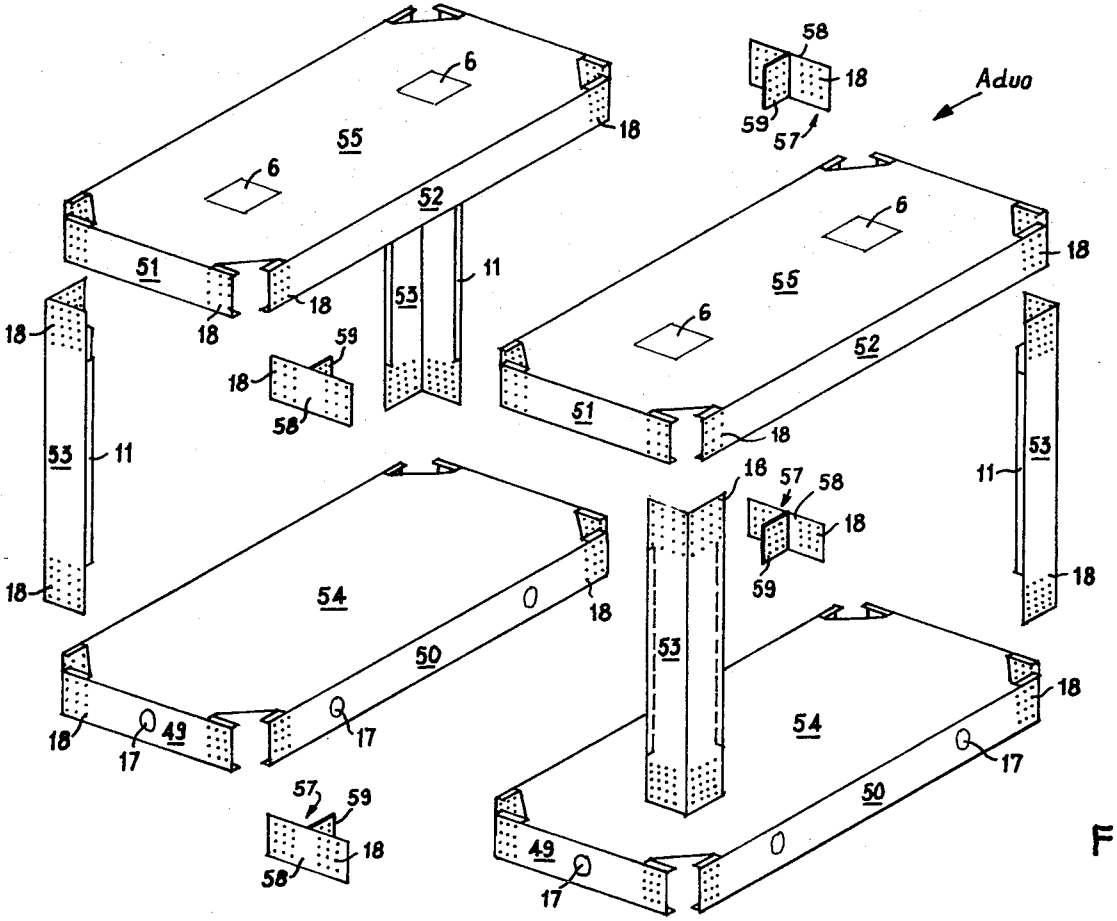
FIG. 17 is an exploded view showing the prefabricated parts (similar to those used for forming the unit illustrated in FIG. 14), whose assembly by bolting permits the formation of a large unit having a rectangular base.

FIG. 17 shows the prefabricated parts whose assembly by bolting makes it possible to form a large unit A duo having a reactangular base; the bottom part of this unit A duo is formed of two parts, each of which corresponds to a bottom part of a unit A (of the type shown in FIG. 14). These two parts are joined side by side by bolting. This bolting-together requires the use of two elements 57, which have a T-shaped section. Each element 57 is composed of a rectangular flat steel bar 58 and a smaller rectangular flat steel bar 59 welded perpendicularly to the middle of the rectangular flat bar 58. The rectangular flat bar 58 has a thickness which is equal to the thickness of the flanges of the uprights 53; the rectangular flat bar 59 has a thickness which is equal to twice the thickness of the flanges of the uprights 53.

The flat bars 58 and 59 are provided with bolt holes 18 which are disposed in such a manner as to correspond with the bolt holes 18 of the elements 49 and 50. When the various elements are joined together the flat steel bar 59 (of the element 57) is interposed between the elements 50, while the flat steel bar 58 takes up position against the outer face of the elements 49. The elements are joined together with the aid of a series of bolts and nuts.

The top part of the unit A duo is formed in the same manner by bolting together two parts, each of which corresponds to a top part of a unit A (of the type shown in FIG. 14). Two elements 57 are likewise required for the bolting together of these parts.

The top and bottom parts of the unit A duo are joined together by four uprights 53 in the same manner as that employed for the units A (of the type shown in FIG. 14).

Figure 18:
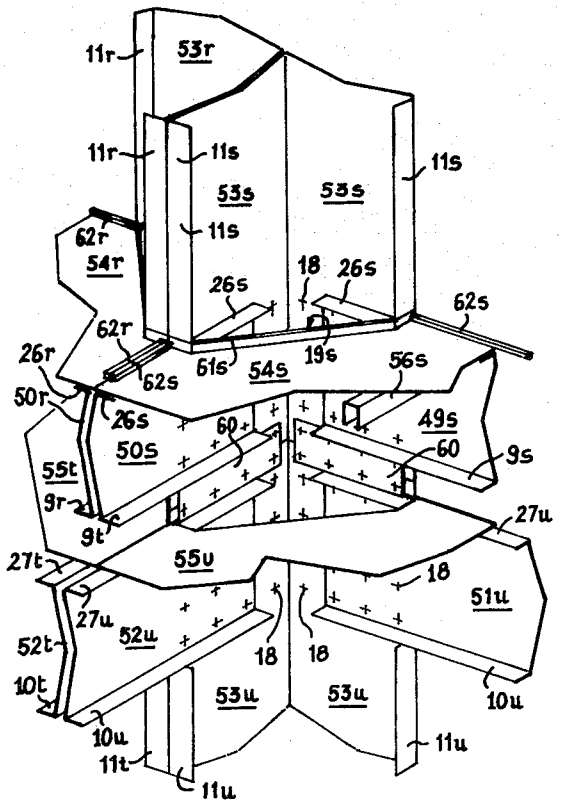
FIG. 18 is a detail view on a larger scale (with parts broken away), showing the system of assembly of the units at the meeting point of two units (of the type illustrated in FIG. 14) superposed on two other units of the same type.

FIG. 18 is a detail view on a large scale (with parts broken away) showing the system of joining the units at the meeting point of four units A (of the type shown in FIG. 14), two units (Ar and As) being superposed on two other units (At and Au). In order to facilitate understanding of the drawing, each element shown is designated by its reference numeral (as in FIG. 14) followed by the reference letter corresponding to the unit to which it belongs. Thus, for example, the bottom wall of the unit As will be called 54*s* and the top wall of the unit Au will be called 55*u*.

The upright 53*s* projects below the bottom edge of the elements 49*s* and 50*s*. The upright 53*u* projects above the top edge of the elements 51*u* and 52*u*. The uprights 53*s* and 53*u* are joined together by bolting with the aid of cover plates 60. The uprights 53*r* and 53*t* are joined together in the same manner (this is not visible in FIG. 18). The uprights 53*r* and 53*s* are joined together with the aid of a series of bolts which pass through the holes 18. The uprights 53*t* and 53*u* are joined together in the same way.

Near the opening 19*s* a rib 61*s* is welded or screwed against the top surface of the bottom wall 54*s*. The bottom walls 54 of all the units are provided with such ribs 61 near each opening 19.

It can be seen that the elements 50*r* and 50*s* are not contiguous. they are in fact separated by a distance which is equal to twice the thickness of the flanges of the uprights 53. The same is true of the elements 52*t* and 52*u*.

On the other hand, the bottom walls 54*r* and 54*s* are contiguous. The same is true of the top walls 55*t* and 55*u*.

Along the edges of the bottom walls 54*r* and 54*s* small ribs 62 are fixed against the upper face of these walls. These small ribs 62 consist for example of small metal bars having a square section with a side length of 1 cm and welded or screwed to the walls 54. These small ribs 62 may however also be made of polymeric plastics material; in this case they are adhesively bonded to the walls 54.

FIG. 19 is a detail view similar to that in FIG. 18, but it shows the system of connections at the meeting point of four units A (Aw, Ax, Ay, and Az) of a slightly different type. The units Aw, Ax, Ay, and Az have a structure similar to that of the unit A which is shown in FIG. 14, and they comprise identical uprights 53 (of steel). However, the "upper and lower frames" and the top and bottom walls are made of wood (and not of steel). A "lower frame" is composed of wooden beams 63 and 64. An "upper frame" is composed of wooden beams 65 and 66. The bottom wall 67 and top wall 68 consist of very thick plywood. The rigidity of the walls 67 and 68 is reinforced with the aid of wooden or metal stiffeners (not shown).

Otherwise the units Aw, Ax, Ay, and Az are similar to the units Ar, As, At, and Au and the system of joining the units together is the same.

Figure 20:
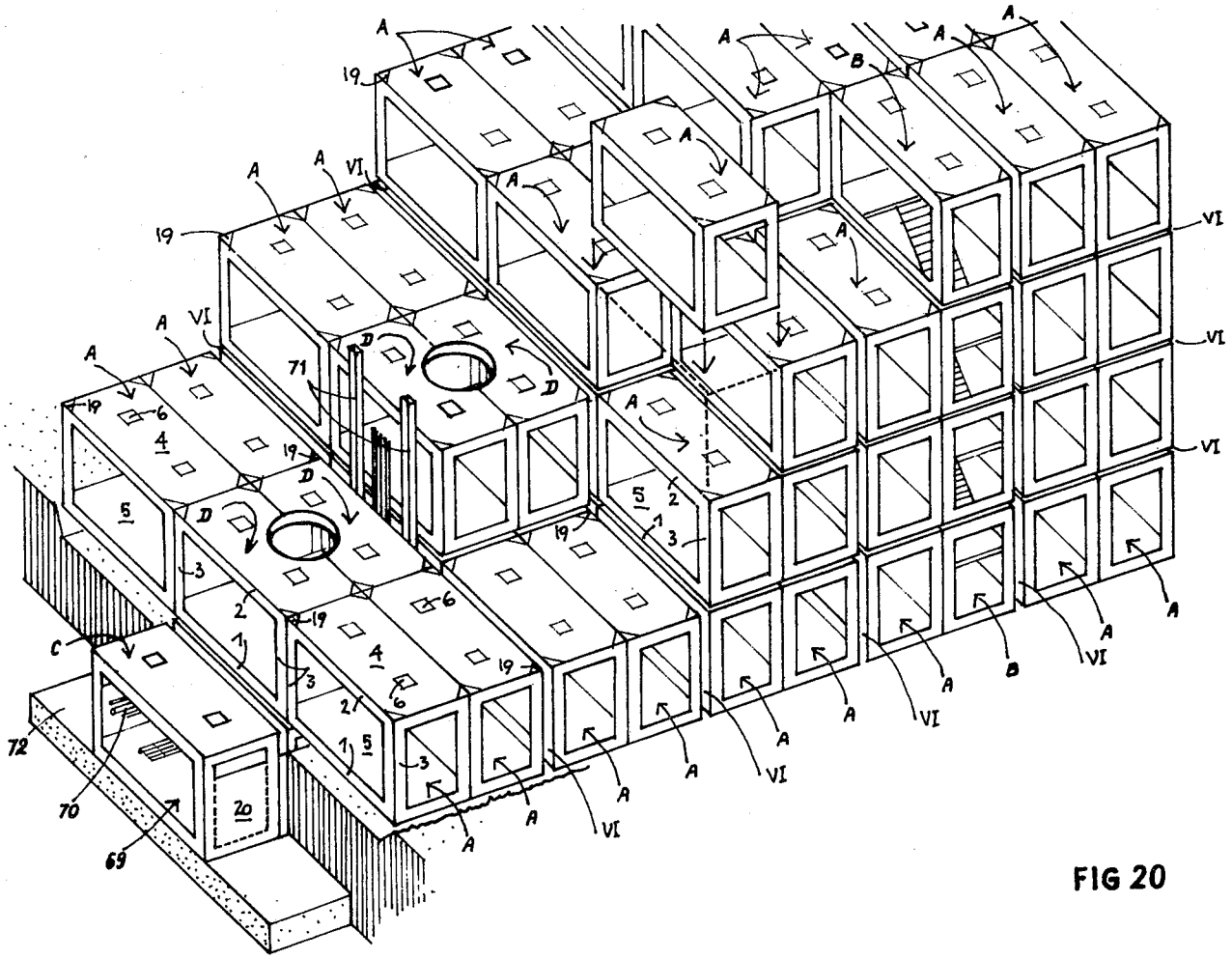
FIG. 20 is a view in isometric projection (partly exploded) showing the fabric of a building constructed in accordance with the invention.

FIG. 20 shows by way of example the fabric (incomplete) of a building according to the invention. The bottom level of this building consists of a technical tunnel 69 in which are installed cables and pipes 70 (water, gas, electricity, drains, etc) which serve the building and to which are connected riser pipes and down pipes 71 installed in the empty spaces between the successive stacks of pairs of building units. This technical tunnel 69 is formed of a series of units C (of which only one is visible in the drawing) disposed on following the other and resting directly on a foundation floor 72, to which they are fixed by means known per se. The units C are disposed side by side and joined together in pairs (by their large side faces); a space (for example 30 cm) is allowed between the pairs of units C following one another. Attached sheet metal panels join together neighbouring non-contiguous units C, thus completing the walls of the technical tunnel. The panels 20 (see FIG. 3) which partly close the small side faces of the units C prevent earth from penetrating into the technical tunnel 69. However, as there is an opening between the panels 20 and the upper frame 2 of the units C, access is thus possible by way of the technical tunnel 69 to the space situated between the ground and the groundfloor units situated on the façade (cantilevered against the units which form the aforesaid stacks).

Each pair of units C carries a stack of subassemblies, each of which is formed by joining together, side by side, two units A or two units D. The units of one and the same stack rest on one another, but a space is left between the top edge of the upper frame of each unit and the bottom edge of the bottom frame of the unit which is superposed thereon (as shown in FIGS. 12, 18, and 19).

Against the free side faces of the sub-assemblies of the said stacks are attached, in a cantilever arrangement, other sub-assemblies also formed of two units joined together. The majority of these sub-assemblies are formed by joining together two units A. Some of these sub-assemblies attached in a cantilever arrangement are nevertheless formed by joining together a unit A and a unit B. The units B disposed vertically in line with one another form a staircase well.

It should be noted that in this building all the sub-assemblies of the said stacks are spaced apart from one another. The cantilevered sub-assemblies apply the stresses of their own weight and of their superposed load only to the stacked sub-assemblies to which they are fixed. These cantilevered sub-assemblies are spaced apart from one another. The empty spaces which separate the cantilevered sub-assemblies are all in communication with one another and also with the empty spaces formed between the sub-assemblies of the stacks, thus forming a continuous void designated by the reference letters VI.

FIGS. 21 to 25 illustrate diagrammatically some of the numerous possible assemblies of units having a rectangular base (A, B, C, D, and E) disposed in accordance with an orthogonal grid.

Figure 21:
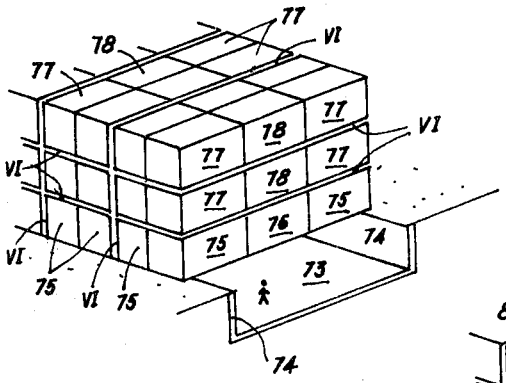
FIGS. 21 to 25 are diagrammatical views in isometric projection (on a smaller scale), illustrating some of the numerous possible assemblies of units for the formation of buildings.

FIG. 21 shows the structure of a building in which the substructure consists of a horizontal floor 73 and two vertical walls 74 of reinforced concrete, which serve to support the whole of the building. The bottom level of the building is composed of series of units, each formed of three units joined together end to end by their small side faces; each of these series of three units forms a "bridge" structure of which only the ends rest on the walls 74. The units situated at the ends of each series are designated by the reference numeral 75. Between two units 75 is disposed a unit 76 attached to the two units 75 by its small side faces. Each series composed of two units 75 and a unit 76 carries a stack of series of three units consisting of two units 77 and one unit 78 attached between them in the same manner as the units 75 and 76. These series of three units are superposed with the interposition of spacers 46, and are supported on one another solely on the side where the free small faces of the units are situated. Each series of three units forms a "bridge" structure, of which only the ends rest on the ends of the series immediately below and support the ends of the series which is immediately above. The structure shown in FIG. 21 can be extended both horizontally and vertically.

The horizontal floor 73 and the walls 74 form in the basement a tunnel which can in particular be used as a garage for vehicles which is free of intermediate support points.

In imagination the building shown in FIG. 21 can be broken down into "sections", each comprising three bottom level units disposed in a "bridge" arrangement (two units 75 and one unit 76), and all the units disposed above these three units. In one advantageous embodiment a space is left between the said "sections", or between some of them. In one particular embodiment these "sections" are bolted together two by two, but a space is left between the juxtaposed pairs of "sections". This arrangement thus forms between the successive "sections", or at least between some of them, voids designated by the reference VI. These voids VI are in communication with the voids VI which exist between the units disposed one above the other. These voids VI offer numerous advantages. In particular, they provide excellent acoustic insulation between groups of neighbouring units. They also serve as expansion and compression joints between groups of neighbouring units, and they thus make it possible to compensate for manufacturing tolerances in these units and also tolerances in the assembly of the latter. It is also possible for vertical and horizontal pipes and cables of all kinds to be installed in these voids VI. In one advantageous embodiment the voids VI constitute ducts for a radiation type thermal conditioning installation which is adapted to provide a suitable temperature inside the building. The corner casings which have been described above (with reference to FIG. 2) play an important part in a thermal conditioning system of this kind. This system of thermal conditioning consists in fact in creating a circulation of air at a suitable temperature in a closed circuit, in the aforesaid corner casings and in the voids VI which separate the walls of units or groups of units. In order to permit the creation of a closed circuit of this kind, the said voids VI are completely isolated by means of partitions from the interior of the units and also from the outside atmosphere. These partitions comprise facade panels and also attached panels disposed at suitable points in the top and bottom levels of the building. When horizontal communications are provided between units spaced apart from one another, the vertical voids VI are isolated from the interior of the units by connecting casings of suitable type which bridge over these voids VI. Openings provided in the aforesaid continuous vertical corner casings bring the latter into communication, on the various storeys of the building, with the aforesaid voids VI. Air brought to a suitable temperature by a heat exchanger (heater or refrigerating machine), preferably installed at the top level of the building, is injected into the said continuous vertical casings (GV), whence it escapes through the openings provided in these continuous vertical casings GV and is thus distributed in the voids VI on the different levels of the building. The air contained in these voids rises to the top level of the building, where return outlets are provided, from which this air returns to the aforesaid heat exchanger, passing through a fan which causes the circulation of air.

Figure 22:
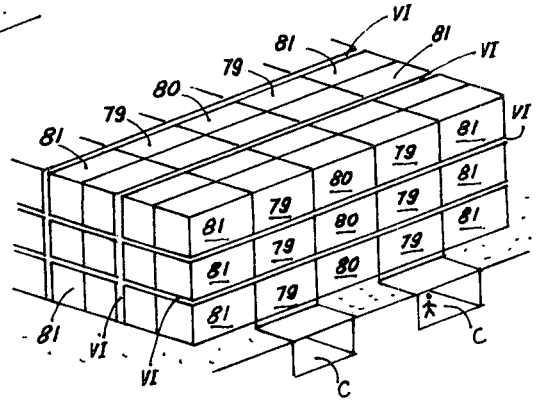

FIG. 22 shows a building in which the bottom level comprises two technical tunnels, in which are installed cables and pipes serving the building. Each of these technical tunnels consists of a series of units C disposed one following the other and resting directly on the foundations. Each unit C carries a stack of rectangular units 79 resting one on the other with the interposition of spacers 46. Between these series of units 79 are disposed units 80 attached by their small side faces against the small side faces of the units 79; these units 80 are thus disposed in a "bridge" arrangement between pairs of units 79. Units 81 are attached in cantilever fashion against the units 79. These units 81 are attached by one of their small side faces against a small side face of a unit 79. The units 80 and 81 do not rest directly on the ground and do not rest on one another. The units C and the units 79 stacked above these units C are thus the only units which support and transmit to the foundations of the building the loads and superposed loads of the whole of the fabric thus constituted, the cantilever units (81) or "bridge" units (82) applying the stresses of their own weight and of their superposed loads only to the units 79 to which they are fixed.

The panels 20 which partly close the small side faces of the units C prevent earth from penetrating into the technical tunnel. However, as there is an opening between these panels 20 and the upper frame 2 of the units C, access can easily be gained through the technical tunnel to the space situation between the ground and the ground floor units 80 and 81.

Like the building shown in FIG. 21, the building shown in FIG. 22 is subdivided into "sections" separated from one another by voids VI which are in communication with the voids VI which exist between the superposed units. These voids VI offer the advantages which have been previously described.

Figure 23:
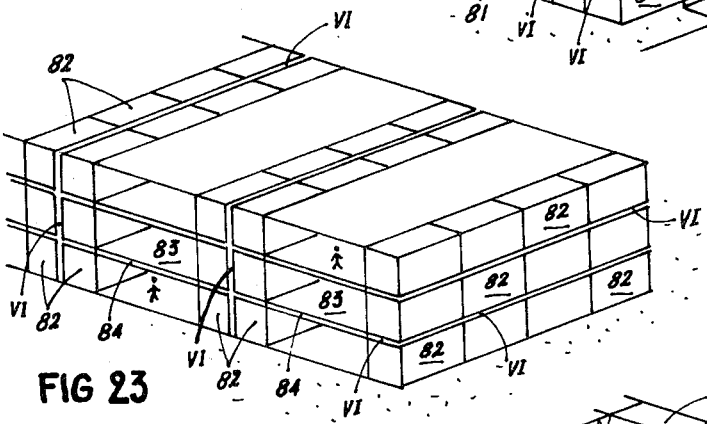

FIG. 23 shows a building which comprises series of rectangular units 82 juxtaposed and superposed one on the other (with the interposition of spacers 46), so as to form parallel "sections". In general, each of these series of units is composed of two of these "sections" separated by a void VI. The series of units situated at the end of the building comprises only a single "section". Each of the series of units forms a sort of thick, hollow supporting wall serving as support for floors 83. These floors 83 are in fact double floors consisting of two parallel horizontal walls separated by an empty space 84. The combination of the voids VI and 84 makes it possible to create a system of thermal conditioning similar to that described previously.

Figure 24:
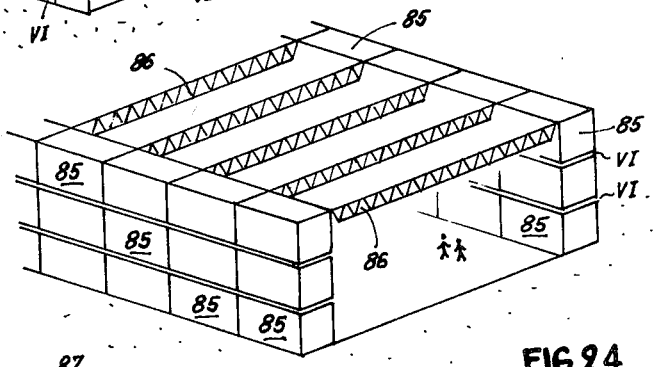

FIG. 24 shows a building which comprises two series of rectangular units 85; each of these series forms a sort of thick, hollow supporting wall serving as support for beams 86 adapted to carry a roofing or platform. A building of this type, shown in FIG. 24, may serve in particular as a hangar, as a sports hall, and so on. These "hollow walls" offer the advantage that persons and objects can circulate therein horizontally and vertically, and that vertical and horizontal pipes and cables can be installed in them.

The buildings shown FIGS. 21, 22, 23, and 24 are all composed of units having a rectangular base. Most of the units used in the construction of these buildings are units A. However, in places where it is desired to install a spiral staircase, some of these units A are replaced by units E or units D. In addition, certain series of units disposed vertically in line with one another may consist of units B, in such a manner as to form in this way a staircase well or lift or elevator well.

Figure 25:
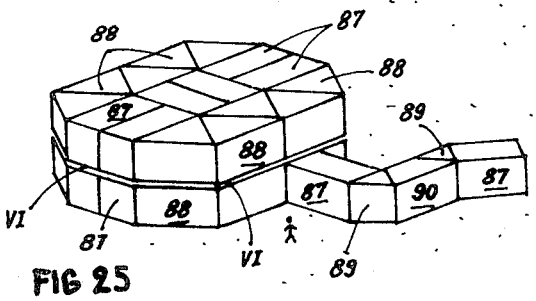

FIG. 25 is a view in perspective of a building erected by the assembly of units 87 having a rectangular base (selected from units A, B, C, D, and E), large units 88 having a triangular base (selected from units J, K, L, and M), small units 89 having a triangular base (selected from units N and P), and units 90 having a trapezoidal base (selected from units Q and R). As in previously described buildings, some of these units are stacked on one another with the interposition of spacers 46, thus creating an empty space VI.

Figures 26, 27, 28:
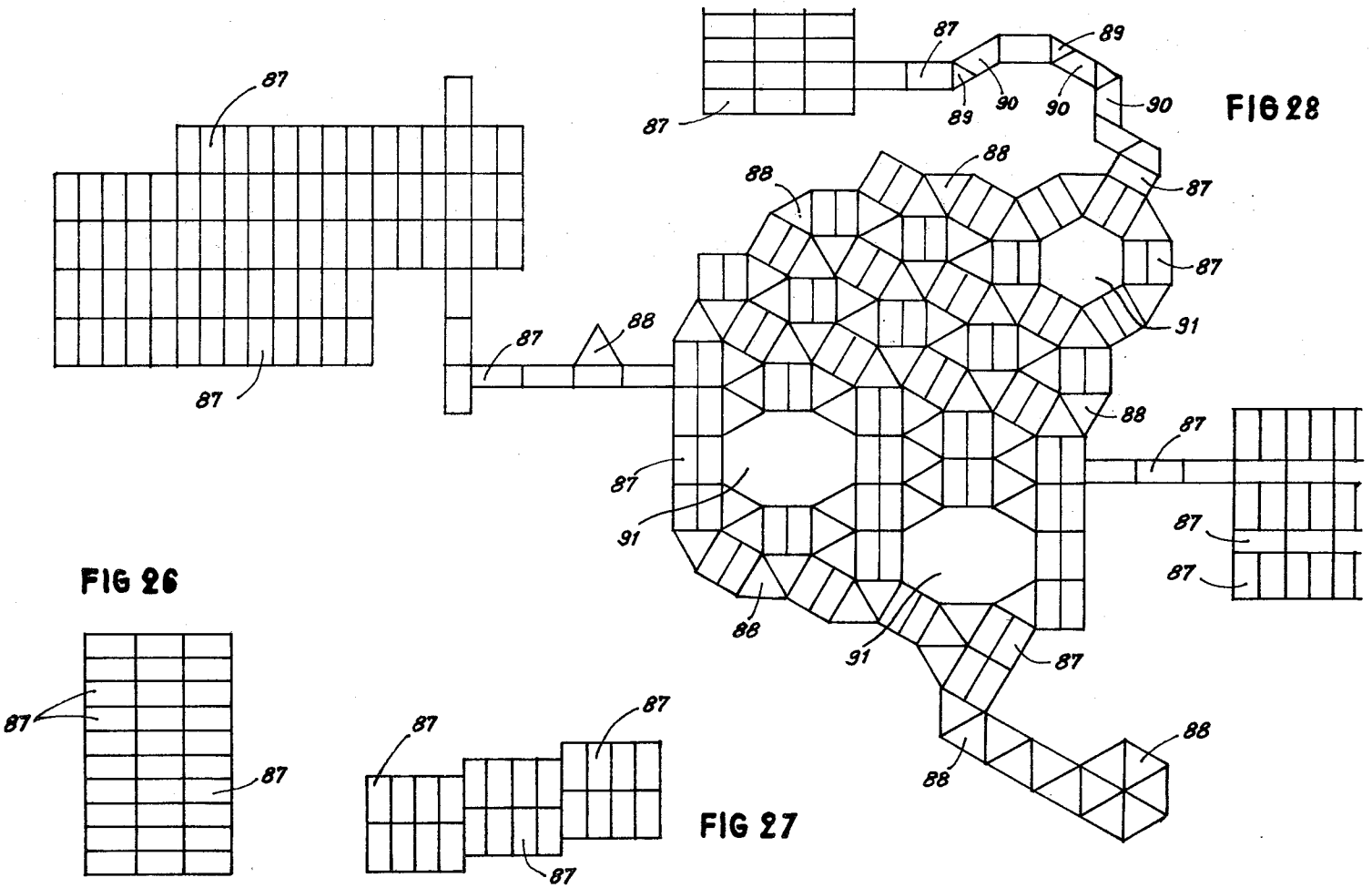
FIGS. 26 to 28 are diagrammatical plan views of some types of building which can be constructed by means of the units according to the invention.

FIGS. 26 to 28 are diagrammatical plan views of somes types of buildings that can be produced with the aid of the units according to the invention.

FIG. 26 shows a building produced solely with the aid of units 87 having a rectangular base and disposed in accordance with an orthogonal grid; this diagrammatical plan view corresponds for example to the building shown in FIG. 21.

FIG. 27, which shows another type of building constructed with the aid of units 87 having a rectangular base, illustrates the possibility of having an offset in the horizontal grid of the plan. Offsets of this kind, optionally combined with vertical offsets, which it is easy to achieve between stacks of units at the point where they are separated by vertical voids VI, make it possible to adapt buildings to the lay-outs of road systems and level curves of the ground.

FIG. 28 is a diagrammatical plan view of an architectural complex. It may be observed that the construction of this complex makes use of units 87 having a rectangular base (selected from the units A, B, C, D, and E), large units 88 having a triangular base (selected from the units J, K, L, and M), small units 89 having a triangular base (selected from units N and P), and units 90 having a trapezoidal base (selected from units Q and R). Some of the component units of this building may be disposed either in a cantilever or in a "bridge" arrangement. Some groups of building units surround empty spaces, thus forming light wells 91.

The fabric of the buildings produced with the aid of the units of the invention is completed by a covering composed of façades and roofings.

The façades are obviously parallel to the vertical walls of the units which are situated on the periphery of the building. They close the whole arrangement and provide, or do not provide, depending on requirements and in suitable positions, an empty space between them and the cells of the periphery of the building, which empty space is in communication with the spaces which exist between the superposed units and, where applicable, also with the empty spaces between the "sections" of the building. These façades can be made of light materials and, in this case, are secured by means known per se to the units which are situated on the periphery of the building, taking advantage of the numerous bolt holes which are provided in the vertical walls of all the units.

These light façades may optionally be made by craftsman with the aid of very usual materials, but they may also consist of modern curtain walls.

Balconies, terraces, or circulation passageways may be attached to the units which are situated on the periphery of the building, this being done with the aid of fastening elements passing through the façades.

The façades may however also be made of heavy materials, for example masonry. In this case, they must be constructed against or near the peripheral units, and must be seated on their own foundations.

One or more roofings are carried by top floor units; when the building comprises units disposed in a cantilever or "bridge" arrangement, it is generally preferable for the roofings not to be supported on these units, but only on the stacks of units which rest one on the other. These roofings may have the most diverse shapes and may be made of widely varying materials, depending on the region, the climate, and the shape of the buildings.

Rain water may be thrown off directly to the outside or may be conducted to vertical pipes, which will advantageously be accommodated in the voids VI or in the corner casings.

FIGS. 29 and 30 illustrate diagrammatically the forced circulation of air in a thermal conditioning installation of a building of the type shown in FIG. 20. The air, brought to a suitable temperature by a heat exchanger 92 (heater or refrigerating machine), passes through outlet conduits CD and descends in the continuous vertical casings GV. The air carried by the casings GV escapes through holes 93 provided in the ducts which connect together the corner casings of the building units; this air is thus distributed in the void VI to all the storeys of the building. The air contained in the empty space VI thus rises to the top level of the building where air return outlets (not shown) are installed, these outlets being connected to metal sheets which at the top level of the building enclose the spaces between neighbouring units. (The air which rises in the void VI is indicated in FIG. 29 by broken lines and in FIG. 30 by undulating lines). All the return outlets are connected to one or more supply conduits CA. The air carried by the supply conduit or conduits CA returns to the heat exchanger 92, passing through a fan (not shown) which brings about the circulation of air.

It is obviously essential that the void VI should be completely isolated (by means of partitions) from the interior of the units and also from the outside atmosphere. At the top level of the building the metal sheets to which the air return outlets are connected form the partitioning between the void VI and the space contained between the roofing T and the units of the top storey.

If desired, it is also possible for the space under the roof also to participate in the air circulation system of the thermal conditioning installation. This can in particular be achieved by connecting, at suitable points, (calibrated) air outlets on the outlet conduits CD, and air return outlets on the supply conduits CA. In this way part of the air passing through the heat exchanger 92 circulates in the space between the roofing T and the units of the top storey, thus bringing the ceilings of these units to a suitable temperature.

Thermal insulating panels, forming a continuous horizontal partition 94 under the ground floor of the building, are fixed to the projecting edges 9 of the building units which form the ground floor with the aid of metal fasteners which leave a space (of for example about ten centimeters) between these projecting edges 9 and the partition 94. In this way the air which is injected under the floors of the ground floor building units can pass under these projecting edges and rise in the void VI.

In the embodiment illustrated in FIGS. 29 and 30 there are no corner casings on the sides where the facades F are situated. The openings 19 (in the top wall 4 and bottom wall 5 of the building units A) which are situated near the façades F are closed by means of attached panels 95.

It should however be noted that this embodiment is given only as an example.

It should be observed that the very characteristics of the invention promote standardisation and prefabrication of all the additional components used in the construction of buildings produced with the aid of the units according to the invention (roofings, façades, partitions, technical equipment, and so on).

It should also be observed that the utilisation, most usually by simple installation, of all these supplementary components is particularly facilitated by the characteristics resulting from the invention, among which characteristics the judicious arrangement of the voids VI and corner casings plays an important part.

It is the combination of all these factors, together with the simplicity and economy of the building units themselves, that gives rise to the economic advantages resulting from the invention.

It should also be observed that building units can be equipped, on the ground, with façade elements, partitions, various pipes and cables and appliances, before being placed in position with the aid of cranes, for the purpose of forming buildings. This work can be carried out by assembly line methods on open worksites.

The invention is obviously not limited to the embodiments which have been described and illustrated as non-limitative examples, and numerous modifications can be made thereto without departing from the scope of the invention.

I claim:

1. A building unit for constructing buildings comprising a metallic structure having the shape of a right prism, said structure comprising:

a lower frame formed of wide flat bars disposed along the side faces of the prism in such a manner that the bottom edge of such frame forms the sides of the bottom base of the prism;

an upper frame formed of wide flat bars disposed along the side faces of the prism in such a manner that the top edge of such upper frame forms the sides of the top base of the prism;

uprights having a V-shaped section joining together said frames, each upright being disposed in such a manner that its edge forms a vertical edge of the prism and that its flanges, formed of wide flat bars, are disposed along the side faces of the prism; and a metal sheet attached to each of said frames and forming, respectively, a self-supporting lower horizontal wall at a predetermined level across said lower frame and a self-supporting upper horizontal wall at a predetermined level across said upper frame, whereby said frames and respective walls together form empty boxes open at the bottom.

2. A building unit according to claim 1 wherein the bottom part of the lower frame, the bottom part of the upper frame, and the vertical edges of the flanges of the uprights are provided with projecting edges directed at right angles towards the interior of the building unit.

3. A building unit according to claim 1 wherein the top part of the lower frame and the top part of the upper frame are provided with projecting edges directed at right angles towards the interiors of the said frames.

4. A building unit according to any one of claims 1, 2 or 3 wherein said bottom horizontal wall is offset downwardly with respect to the top edge of said lower frame, whereby the top portion of the lower frame forms an upwardly directed projecting edge along the edges of the bottom wall.

5. A building unit according to any one of claims 1, 2 or 3 wherein said metal sheet is attached to the top edge of the lower frame.

6. A building unit according to claim 5 wherein the bottom horizontal wall is provided on its upper face with a projecting edge which follows the periphery of said bottom wall.

7. A building unit according to any one of claims 1, 2 or 3 wherein under the level of the bottom horizontal wall said lower frame is provided with one or more openings permitting the passage of pipes and/or cables.

8. A building unit according to claim 1 wherein at least one of said horizontal walls is provided with openings near the vertical edges of the prism.

9. A building unit according to claim 1 wherein at least one of said horizontal walls is provided with a circular opening permitting the installation of a spiral staircase for passage between superposed building units.

10. A building unit according to claim 1 wherein at least one of said horizontal walls is provided with a semi-circular cutout whose center is situated on a horizontal edge of said prism, the wide flat bars which form the corresponding frame being so shaped as to follow the edge of the cutout horizontal wall to which they are attached, and the arrangement and diameter of the said cutout being such that when two building units provided with such cutouts are connected side by side the semi-circular cutouts complement one another to form a circular opening permitting the installation of a spiral staircase for passage between superposed building units.

11. A building unit according to claim 1 including metal rib stiffeners affixed to at least some of said metal sheets and bars, the stiffeners of a bottom horizontal wall being fixed against the bottom face of the latter and all the stiffeners provided on the building unit being so disposed and arranged that they do not project beyond the side faces of the prism formed by said building unit.

12. A building unit according to claim 1 wherein at least one of said frames is interrupted at least at one of its corners.

13. A building unit according to claim 1 formed of factory-prefabricated elements comprising:

(a) a lower frame provided with a bottom wall (b) a upper frame provided with a top wall (c) four uprights.

14. A building unit according to claim 13 having the shape of a right prism having a rectangular base and formed of prefabricated structural elements, comprising:

(a) a bottom part which is formed of two identical rectangular parts joined together side by side on the building site, each comprising a lower frame and a bottom wall;

(b) a top part which is formed of two identical rectangular parts joined together side by side on the building site, each comprising an upper frame and a top wall; and (c) four uprights.

15. A building composed of a plurality of superposed and juxtaposed building units bolted together, each such unit comprising a metallic structure having the shape of a right prism, said structure further comprising:

a lower frame formed of wide, flat bars disposed along the side faces of the prism in such a manner that the bottom edge of such frame forms the sides of the bottom base of the prism;

an upper frame formed of wide, flat bars disposed along the side faces of the prism in such a manner that top edge of such upper frame forms the sides of the top base of the prism; and uprights having a V-shaped section joining together said frames, each upright being disposed in such a manner that its edge forms a vertical edge of the prism and that its flanges, formed of wide, flat bars, are disposed along the side faces of the prism, said units being adapted to be fastened to each other along at least one pair of adjacent surfaces of the prism;

a bottom horizontal wall attached to its lower frame comprising a metal sheet connected thereto at a predetermined level with respect to the top edge thereof; and, a top horizontal wall attached to its upper frame at a predetermined level with respect to the top edge thereof, said horizontal walls being self-supporting, whereby each forms, together with its frame, an empty box open at the bottom.

16. A building in accordance with claim 15 including a plurality of stacks spaced apart from one another and formed of building units resting one on the other, each level of each stack being composed of a building unit or of two or more building units juxtaposed side by side and joined together, while spacers form a space between the top edge of the upper frame of each building unit of each stack and the bottom edge of the lower frame of the building unit superposed on it, and further including building units which are not supported by their bottom face and are fixed solely by one or more of their side faces against one or more of the free side faces of the building units forming the said stacks.

17. A building according to claim 16 wherein said spacers form part of the building units themselves and are formed by the ends of the uprights of the building units, such uprights being extended beyond at least one edge of an associated frame.

18. A building in accordance with claim 15 including one stack formed of building units resting one on the other, each level of said stack comprising a building unit or two or more building units juxtaposed side by side and joined together, while spacers form a space between the top edge of the upper frame of each building unit of said stack and the bottom edge of the lower frame of the building unit superposed on it, and further including building units which are not supported by their bottom face and which are fixed solely by one or more of their side faces against one or more of the free side faces of the building units forming said stack.

* * * * *